US011286689B1

(12) United States Patent
Marton

(10) Patent No.: US 11,286,689 B1
(45) Date of Patent: Mar. 29, 2022

(54) APPARATUS FOR ATTACHING LOCKBOX TO DOOR

(71) Applicant: Donald Marton, Parkland, FL (US)

(72) Inventor: Donald Marton, Parkland, FL (US)

( * ) Notice: Subject to any disclaimer, the term of this patent is extended or adjusted under 35 U.S.C. 154(b) by 0 days.

(21) Appl. No.: 17/461,939

(22) Filed: Aug. 30, 2021

Related U.S. Application Data

(63) Continuation-in-part of application No. 17/302,768, filed on May 12, 2021, now Pat. No. 11,137,108.

(60) Provisional application No. 63/180,146, filed on Apr. 27, 2021.

(51) Int. Cl.
*E05B 19/00* (2006.01)
*E05B 13/00* (2006.01)
*E05B 67/02* (2006.01)

(52) U.S. Cl.
CPC ..... *E05B 19/0005* (2013.01); *E05B 13/001* (2013.01); *E05B 67/02* (2013.01)

(58) Field of Classification Search
CPC .. E05B 19/0005; E05B 73/00; E05B 73/0023; E05B 67/02; E05B 13/001; E05B 17/14; E05B 17/142; E05G 1/005; E05G 2700/02; E05G 1/00; E05G 1/02; A45C 1/12
USPC ..... 70/30, 36, 37, 49, 53, 63, 202, 203, 211, 70/212, 177, 178, 180, 451, 232, 416, 70/461, 423–428, 455, 14, 18, 19, 58, 70/DIG. 34, DIG. 43, DIG. 56, DIG. 58; 109/50–52; 292/DIG. 2, 258, 288, 289
See application file for complete search history.

(56) References Cited

U.S. PATENT DOCUMENTS 1,021,456 A * 3/1912 Evans ..... E05B 37/025 70/26
1,274,427 A 8/1918 Landmann
1,475,863 A 11/1923 Pate
1,850,602 A 3/1932 Pineo
2,133,883 A 10/1938 Aubert
2,169,438 A 8/1939 Sherman
2,813,620 A 11/1957 Hansen
3,245,240 A 4/1966 De Forrest
3,457,745 A 7/1969 Barber
3,953,062 A 4/1976 Maston
3,985,275 A 10/1976 Allen
3,990,655 A 11/1976 Covell
(Continued)

OTHER PUBLICATIONS

Shurlok Lever Grip Website Description, Accessed May 12, 2021.
Office Action dated Dec. 1, 2021 in U.S. Appl. No. 17/461,932.

*Primary Examiner* — Lloyd A Gall
(74) *Attorney, Agent, or Firm* — Brian Roffe

(57) ABSTRACT

Apparatus for retaining a key on a door handle or lever. The apparatus includes two arms each with a head portion and a bottom portion having a shackle prong extending in a direction away from the head portion. The arms have an open state in which the head portions are at least partly separated from one another, and a closed state defining an aperture therebetween. A key box has a compartment for containing the key, and receptacles that receive the shackle prongs when the arms are in the closed state. The key box transitions from a closed state in which the shackle prongs are locked in the receptacles to an open state in which the shackle prongs are out of the receptacles upon entry of a shackle release code. The key box enables access to the compartment upon receiving an access code different than the shackle release code.

20 Claims, 13 Drawing Sheets

(56) References Cited

U.S. PATENT DOCUMENTS

| | | | |
|---|---|---|---|
| 3,999,409 | A | 12/1976 | Bell |
| 4,059,209 | A | 11/1977 | Grisel |
| 4,082,334 | A | 4/1978 | Volta et al. |
| 4,146,242 | A | 3/1979 | Bose |
| 4,216,665 | A | 8/1980 | McKelvey |
| 4,299,361 | A | 11/1981 | Webb |
| 4,397,489 | A | 8/1983 | Lind |
| 4,418,550 | A | 12/1983 | Hamilton |
| 4,463,584 | A | 8/1984 | De Forrest |
| 4,532,783 | A | 8/1985 | Maurice |
| 4,570,470 | A | 2/1986 | Gray, Sr. |
| 4,609,780 | A | 9/1986 | Clark |
| 4,641,505 | A | 2/1987 | Maurice |
| 4,651,544 | A | 3/1987 | Hungerford |
| 4,798,069 | A | 1/1989 | DeForrest, Sr. |
| 4,799,370 | A | 1/1989 | Cooper |
| 4,845,966 | A | 7/1989 | Perry |
| 4,913,479 | A | 4/1990 | Allison |
| 5,007,263 | A | 4/1991 | Taylor |
| 5,046,339 | A | 9/1991 | Krell |
| 5,052,202 | A | 10/1991 | Murphy |
| 5,193,366 | A | 3/1993 | Brinkman |
| 5,207,315 | A | 5/1993 | Benda |
| 5,259,220 | A | 11/1993 | Fredrickson |
| 5,347,835 | A | 9/1994 | Dewey |
| 5,375,916 | A | 12/1994 | Cook |
| 5,423,583 | A | 6/1995 | Crockom |
| 5,501,493 | A | 3/1996 | Arthur |
| 5,560,233 | A | 10/1996 | Watkins |
| 5,590,608 | A | 1/1997 | Yore et al. |
| 5,664,287 | A | 9/1997 | Sendelbach |
| 5,704,664 | A | 1/1998 | Naumovski |
| 5,775,149 | A | 7/1998 | Small |
| 5,845,521 | A | 12/1998 | Najera |
| 6,018,968 | A | 2/2000 | Sides |
| 6,330,816 | B1 | 12/2001 | O'Connor |
| 6,813,912 | B1 | 11/2004 | Ng et al. |
| 6,834,519 | B1 | 12/2004 | Yang |
| 7,204,521 | B2 | 4/2007 | Shoen |
| 7,325,424 | B1 | 2/2008 | Wolf, III |
| 7,937,975 | B2 | 5/2011 | Kolton et al. |
| 8,313,128 | B2 | 11/2012 | Belyea et al. |
| 9,670,694 | B2 | 6/2017 | Larson et al. |
| 10,648,196 | B2 | 5/2020 | Neau et al. |
| 10,808,427 | B1 | 10/2020 | Jonak et al. |
| 11,137,108 | B1 | 10/2021 | Marton |
| 2003/0101779 | A1 | 6/2003 | Chappell |
| 2006/0272365 | A1 | 12/2006 | Copus |
| 2010/0206022 | A1 | 8/2010 | Katz et al. |
| 2011/0226023 | A1 | 9/2011 | Freeman |
| 2014/0103668 | A1 | 4/2014 | McKinney |
| 2015/0305538 | A1 | 10/2015 | Sundaresen |

* cited by examiner

APPARATUS FOR ATTACHING LOCKBOX TO DOOR

CROSS-REFERENCE TO RELATED APPLICATION

This application is a continuation-in-part of U.S. patent application Ser. No. 17/302,768 filed May 12, 2021, now U.S. Pat. No. 11,137,108 the entirety of which is incorporated by reference herein.

FIELD OF THE INVENTION

The present invention relates generally to an apparatus for attaching a lockbox used for retaining a key to a door opened by the key and more particularly to an apparatus for securely attaching such a lockbox to a door lever used to open and close the door.

BACKGROUND OF THE INVENTION

In the real estate field, it is common practice for realtors to secure a lockbox on the handle of a door of a residence or commercial property they are listing for sale or rent, with the lockbox having a code to open it and access a key stored therein which in turn enables opening of the door to which the lockbox is secured. In this manner, each realtor only has to give the lockbox code to other realtors to enable them to access his or her listed properties and show them to prospective purchasers without being physically present at the listed property or providing the key to the other realtors.

The inventor, the owner of a residential real estate brokerage and a licensed Real Estate Broker for over twenty-five years, has recognized a particular problem with lockboxes used with doors that have door levers (as used herein, a door levers will be considered the horizontal handle that is attached to a door that allows for its opening and closing by manually depressing and pushing or pulling the door lever). Specifically, a door with a door lever is not able to securely retain conventional lockboxes used by realtors. Door levers are open-ended and the shackles of conventional lockboxes, designed to fit around the door knobs, simply slide off the open end of the door lever. Without the ability to secure a lockbox to a door lever, either the agent or property owner has to be present to provide access when prospective purchasers want to view the property.

More specifically, one common lockbox used by realtors is a Master Lock™ portable lockbox with an adjustable shackle that adjusts in approximately 3 mm increments. The incremental tightening of the shackle creates two issues with door levers. First, the shackle does not always tighten enough to securely fashion the lockbox to the door lever. Second, the incremental tightening of the shackle in some scenarios causes tightening to the point where the lockbox cannot hang freely and is forced to move as the door lever is depressed in order to open the door. When the lockbox shackle is forced to move with the depressing of the door lever, the lockbox can be pinned against a door jamb preventing the door lever from being depressed sufficiently to enable opening of the door.

To overcome this problem, instead of attaching the lockbox to the door lever, realtors sometimes attach the lockbox to a less secure location like a hose spigot or fence, but which alternative locations are often not convenient to access.

In addition, the ShurLok Company markets a product designated by product code SL-170 that is considered an attachment to enable the company's lockboxes to be used with door levers. The apparatus has a two-part plastic housing hinged at the bottom and includes an aperture designed to be placed over the door knob. The housing defines a channel over its top and side edges that receives the shackle of the lockbox, and on one side, a projection which defines an aperture through which the shackle passes. There are significant limitations with this attachment that severely impact its usefulness, for example, it fits a lockbox with only one size of shackle, the shackle goes over the door handle not underneath, and if the lockbox shackle is oblong as is typical, the apparatus can be spread open and the lockbox removed. Its plastic construction is also not ideal.

These flaws and disadvantages have been identified by users. Some identified the flexibility of the apparatus as being excessive enabling removal of the shackle and thus the lockbox from the door while the apparatus remains in place. Other complain about its limited use with only specific lockboxes. Overall, it does not provide an acceptable solution to the problem of attaching a lockbox to a door lever and the inventor believes a better solution is needed.

OBJECTS AND SUMMARY OF THE INVENTION

It is an object of at least one embodiment of the present invention to provide an apparatus for attaching a lockbox used for retaining a key to a door opened by the key and more particularly to a door lever of the door.

It is another object of at least one embodiment of the present invention to provide a lockbox assembly configured to attach to a handle of a door, whether a door knob or door lever.

It is another object of at least one embodiment of the present invention to provide a lockbox assembly attachable to a door handle in which the lockbox is secured to an apparatus and the apparatus is secured to the door handle such that no part of the lockbox, and specifically, not its shackle, encompass or surround any part of the door handle.

In order to achieve at least one of these objects and possibly others, an apparatus in accordance with the invention includes a first arm having a head portion and a bottom portion below the head portion, with the bottom portion arm including a first shackle prong extending in a direction away from the head portion, and a second arm having a head portion and a bottom portion below the head portion and which includes a second shackle prong extending in a direction away from the head portion. The arms have an open state in which the head portions thereof are at least partly separated from one another, and a closed state in which at least one aperture is defined between the head portions. A key box has a compartment for containing one or more access devices, such as a key or gate card, and first and second receptacles that receive the first and second shackle prongs, respectively, when the arms are in the closed state. The key box has a first state in which the shackle prongs are out of the receptacles and a second state in which the shackle prongs are locked in the respective receptacle. The key box is configured to transition from the second state to the first state upon entry of a shackle release code, and also enables access to the compartment upon receiving an access code different than the shackle release code.

In use, the arms are positionable around a door handle or removable from such a position when in the open state and one of the apertures is receivable of the door handle when the arms are in the closed state. When the key box is in the second state, the arms are maintained in the closed state and movement of the arms from the closed state to the open state is prevented and thus, when the arms are around the door handle with the door handle received in an aperture, the arms are maintained around the door handle.

There may be two separated, different-sized apertures defined between the head portions of the arms. To this end, the head portions each include a pair of recess which combine to form two apertures. The two apertures may be spaced apart from one another in a longitudinal direction of the arms. The aperture closer to the bottom portions of the arms can have a larger cross-sectional area than the aperture farther from the bottom portions of the arms.

Another way to consider the apparatus is with an upper portion defining at least one aperture configured to fit around a door handle, a lower portion below the upper portion and including two shackle prongs extending in a direction away from the upper portion, and a key box having a compartment for containing an access device, and two receptacles that receive the shackle prongs when the upper and lower portions are in a closed state. The key box has a first state in which the shackle prongs are out of the receptacles and a second state in which the shackle prongs are locked in the receptacles. The key box transitions from the second state to the first state upon entry of a shackle release code, and enables access to the compartment upon receiving an access code different than the shackle release code. Movement of the upper and lower portions from the closed state to an open state in which the at least one aperture is open is prevented when the key box is in the second state.

Yet another way to consider the invention is as an apparatus including a first arm having a head portion and a bottom portion below the head portion and which includes a first prong extending in a direction away from the head portion, and a second arm having a head portion and a bottom portion below the head portion and which includes a second prong extending in a direction away from the head portion. The arms have an open state in which the head portions thereof are at least partly separated from one another, and a closed state in which at least one aperture is defined between the head portions. The apparatus also includes a key box having a compartment for containing an access device, and engagement structure for engaging with the prongs when the arms are in the closed state. The key box has a first state in which the prongs are disengaged with the engagement structure and a second state in which the prongs are engaged with and locked in the engagement structure. The key box is configured to transition from the second state to the first state upon entry of a release code, and enables access to the compartment upon receiving an access code different than the release code.

The arms are positionable around a door handle or removable from such a position when in the open state and an aperture is receivable of the door handle when the arms are in the closed state. When the key box is in the second state, the arms are maintained in the closed state and movement of the arms from the closed state to the open state is prevented and thus, when the arms are around the door handle with the door handle received in an aperture, the arms are maintained around the door handle.

The prongs may be shackle prongs spaced apart from one another, in which case, the engagement structure is two receptacles each receivable of a respective shackle prong.

BRIEF DESCRIPTION OF THE DRAWINGS

The following drawings are illustrative of embodiments of the system developed or adapted using the teachings of at least one of the inventions disclosed herein and are not meant to limit the scope of the invention as encompassed by the claims.

DETAILED DESCRIPTION OF THE INVENTION

Figure 1:
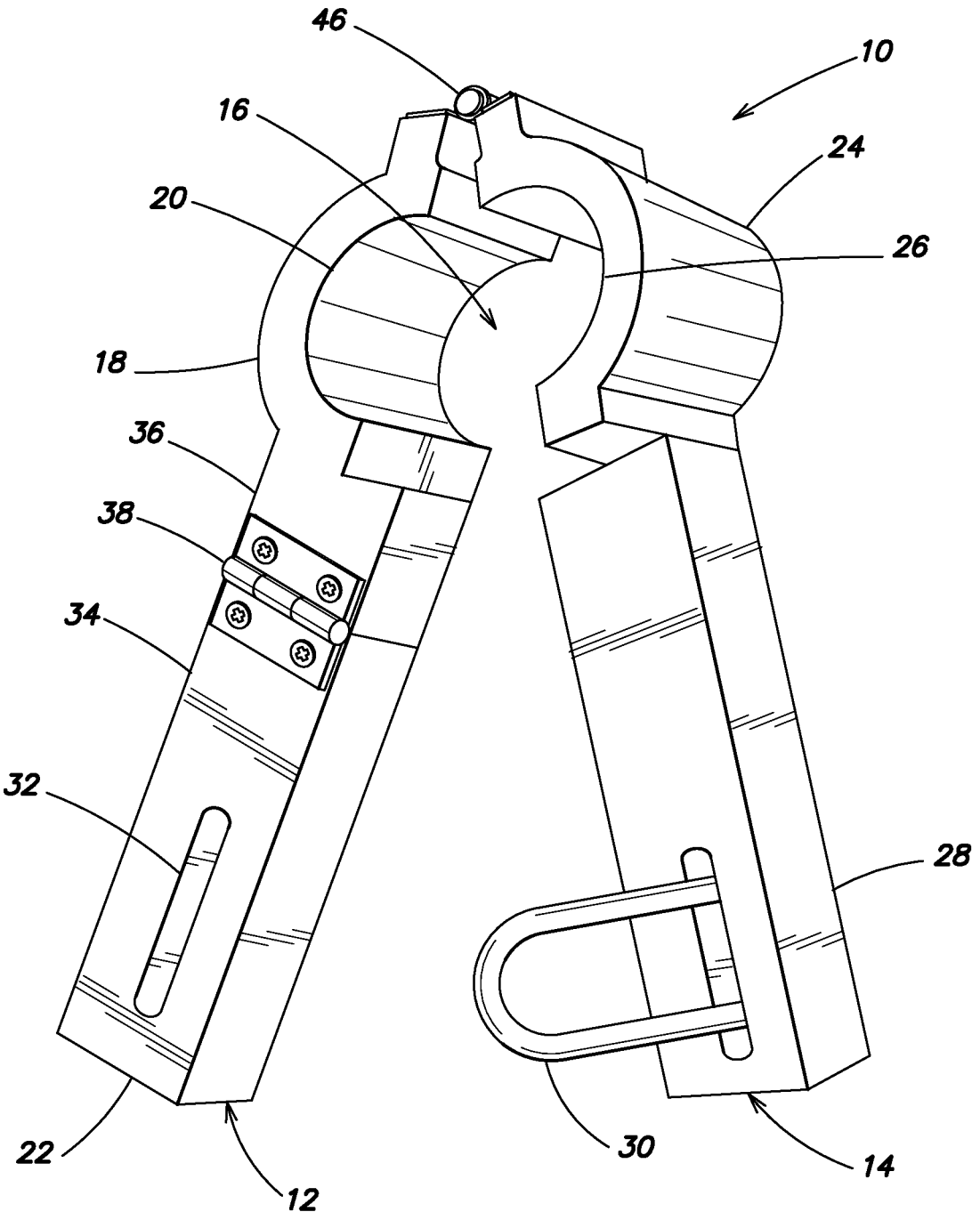
FIG. 1 is a perspective view of an apparatus in accordance with the invention in which arms thereof are in an open state.
Figure 3:
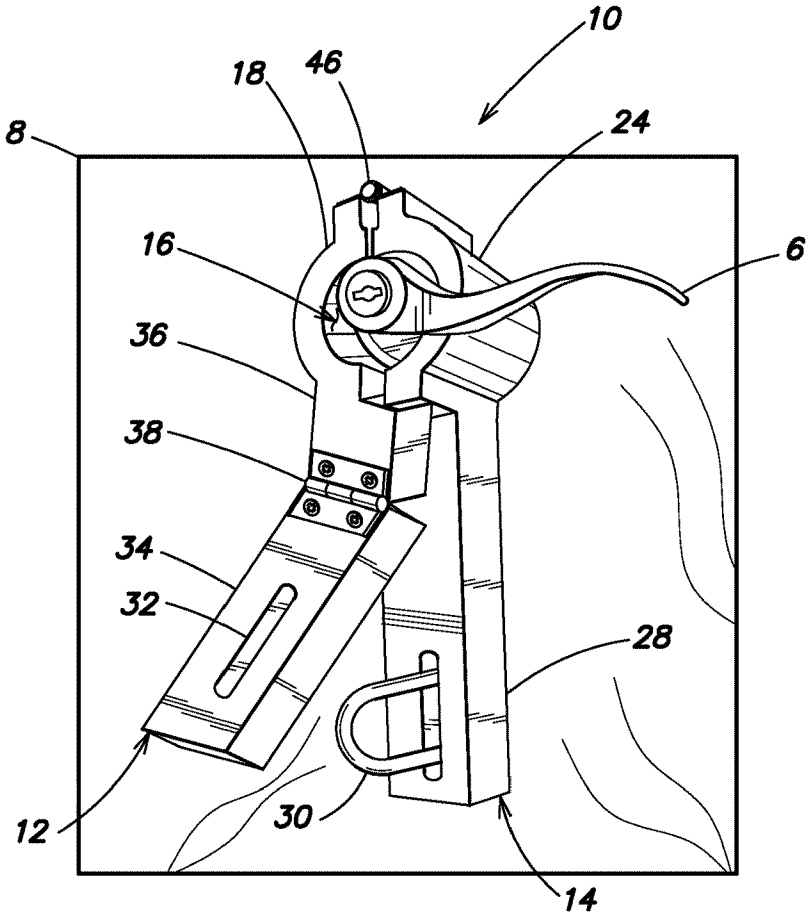
FIG. 3 shows an intermediate stage of attachment of the apparatus in accordance with the invention to the door lever.
Figure 2:
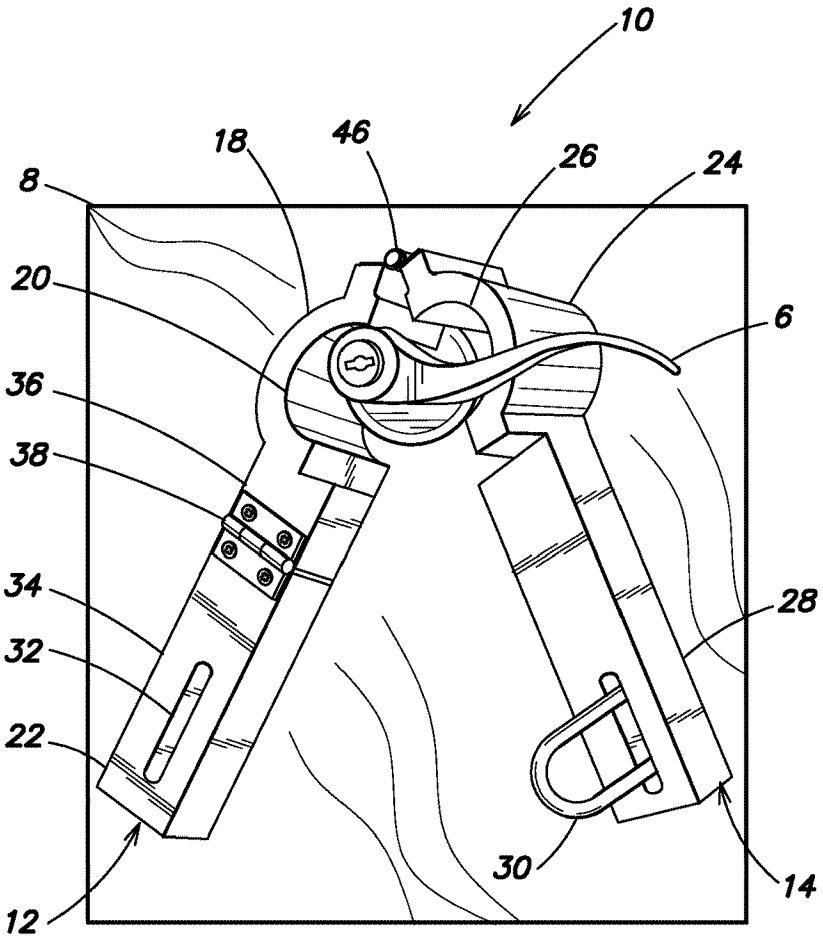
FIG. 2 shows the initial stage of attachment of the apparatus in accordance with the invention to a door lever.
Figure 5:
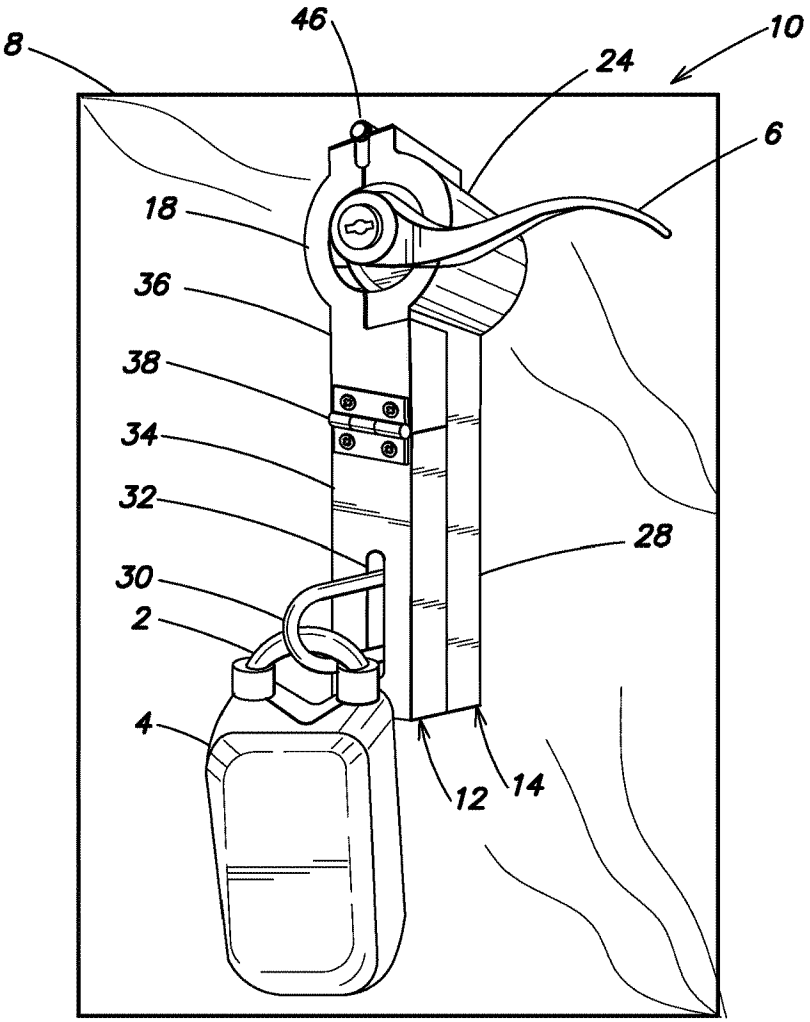
FIG. 5 is a view showing the apparatus in accordance with the invention in use with a lockbox.
Figure 4:
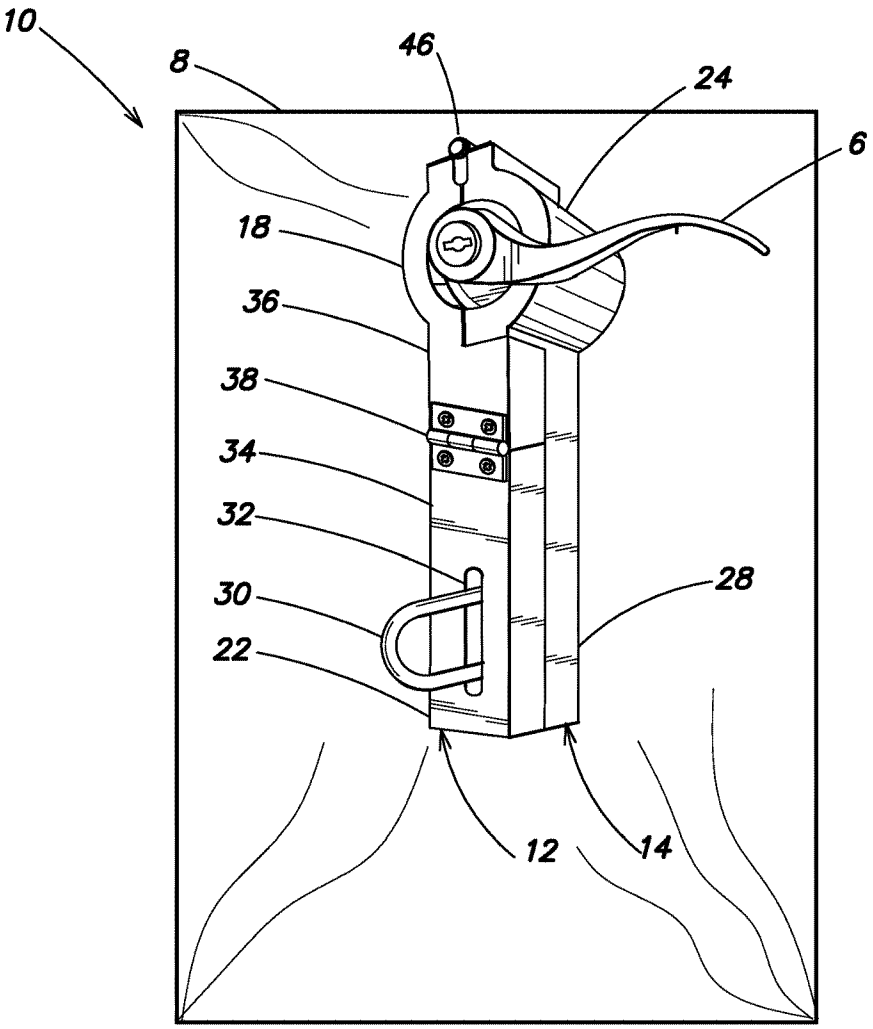
FIG. 4 shows the final stage of attachment of the apparatus in accordance with the invention to the door lever.

Referring to the accompanying drawings wherein like reference numbers refer to the same or similar elements, FIGS. 1-5 show an apparatus 10 in accordance with the invention which generally, and in a preferred use, secures a lockbox 4 to a door lever 6 of a door 8. The apparatus 10 includes two members, which will be referred to as a first arm 12 and a second arm 14, that have a cooperating first, open state in which the first and second arms 12, 14 are at least partly separated from one another (FIGS. 1 and 2) and a cooperating second, closed state in which an aperture 16 is defined between them (FIGS. 3-5). In the open state, the first and second arms 12, 14 are positionable around the door lever 6 or removable from such a position (FIG. 2). (Identification of a preferred use of the apparatus 10 with a lock box 4 and door lever 6 is not intended to limit the invention in any manner whatsoever.) The arms 12, 14 may be considered to be structure that has a body and is generally elongate.

The first and second arms 12, 14 are movable between the first and second states, but in use are preferably locked in the second state to prevent movement of the first and second arms 12, 14 from the second state to the first state and thus, when the first and second arms 12, 14 are around the door lever 6, maintain the first and second arms 12, 14 around the door lever 6 (FIGS. 3-5). The mechanism that effects the locking of the first and second arms 12, 14 in the second state may be any type of conventional lock or lockbox and is not a required part of the invention. However, a lockbox assembly in accordance with the invention includes apparatus 10 and any type of lockbox 4.

When the lockbox 4 is secured to the apparatus 10 as shown in FIG. 5 (in a manner described below), the shackle 2 of the lockbox 4 is secured to the apparatus 10 which in turn is secured to the door lever 6, which is being used herein as an example of a door handle. The apparatus 10 would therefore maintain the lockbox 4 in a secured position on the door lever 6. The lockbox 4 would not be able to be removed while the apparatus 10 is in place and the shackle 2 of the lockbox 4 is secured to the apparatus 10. Realtors could thus insert a key to one of their listings into the lockbox 4 and using the apparatus 10, place the lockbox 4 onto the door lever 6 of the door 8 of this listing. Thereafter, to enable other realtors to show the listed property, they would be able to provide only the code to the lockbox 4 to enable the other realtors to access the key inside and use the key to access the listed property. Apparatus 10 prevents disengagement of the lockbox 4 for the door lever 6, and addresses the drawbacks of the prior art devices discussed above. Use of the apparatus 10 with electronic lockboxes is also possible.

Aperture 16 can be formed by the first and second arms 12, 14 in a variety of different ways, whether by a recess in only one of the arms 12 or 14 or by recesses in each arm 12, 14. As also disclosed below, the aperture 16 may be formed or defined by additional structure that enables its size to be adjustable. In the embodiment illustrated in FIGS. 1-5, the first arm 12 includes a head portion 18 at an upper region of the member that defines a recess 20 and an elongate bottom portion 22 below the head portion 18. The second arm 14 includes a head portion 24 at an upper region of the member that defines a recess 26 and an elongate bottom portion 28 below the head portion 24. The head portions 18, 24 constitute an upper portion of the apparatus 10 while the bottom portions 22, 28 constitute a lower portion of the apparatus 10.

Each recess 20, 26 has a generally semi-circular cross-section in the depth direction of the respective member but its shape can vary and is not limited to being semi-circular or even uniform in the depth direction of the first and second arms 12, 14. Recesses 20, 26 have a shape relative to one another to form the aperture 16 with a cylindrical form, but this is not a required feature and may vary for different embodiments. Head portions 18, 24 are therefore provided with a curved form.

The bottom portion 22 of the first arm 12 has an upper end region integral with the head portion 18, but may alternatively be connected thereto if formed from separate members. The bottom portion 28 of the second arm 14 has an upper end region integral with the head portion 24, but may alternatively be connected thereto if formed from separate members.

The structure that maintains the first and second arms 12, 14 in the second, closed state and prevents their movement from the second, closed state (FIGS. 3 and 4) to the first, open state (FIGS. 1 and 2) has various forms. The purpose of such structure is, when the first and second arms 12, 14 are around a door handle, to maintain the first and second arms 12, 14 around the door handle, whether a door lever or otherwise. This structure will generally be referred to as engagement means for engaging with the first and second arms 12, 14 and maintaining the first and second arms 12, 14 in the second, closed state and preventing movement of the first and second arms 12, 14 from the second, closed state to the first, open state. Thus, when the first and second arms 12, 14 are around a door handle, the engagement means maintain the first and second arms 12, 14 around the door handle. The engagement means do not necessarily include a locking structure, or other structure, that locks the first and second arms 12, 14 in the closed state.

The engagement means may be formed on only the first arm 12, only the second arm, or partly on both of the first and second arms 12, 14. The engagement means may be intrusive in that they require contact with only the first arm 12, only the second arm 14 or with both the first and second arms 12, 14. The specific engagement means illustrated in this application do not limit the scope of the claims.

In one embodiment, the engagement means comprise a generally U-shaped staple 30 in the bottom portion 28 of the second arm 14, and a slot 32 in the bottom portion 22 of the first arm 12 that is dimensioned to allow the staple 30 to pass therethrough. In this embodiment, the first arm 12 is in front of the second arm 14 when the first and second arms 12, 14 are in the closed state since it is better to have an exposed part of the staple 30 in front of the apparatus 10 to enable easy insertion of a shackle of a lock or lockbox through the opening of the staple 30 (the front being the side intended to be facing away from the door). Nevertheless, the staple 30, the slot 32 and the first and second arms 12, 14 could be configured such that the opening of the staple 30 is on a different side of the apparatus 10. The same variation may be made to the other embodiments of the apparatus 10 disclosed herein.

The staple 30 generally may also be considered a support for a lockbox and more specifically a support for a shackle of a lockbox.

The staple 30 has elongate, parallel legs connected to the bottom portion 28 and a curved portion connecting the legs extends in a direction toward the first arm 12 (FIG. 1). Staple 30 extends in a direction from the bottom portion 28 of the second arm 14 to enable it to pass through and extend beyond the slot 32 of the first arm 12, when the first and second arms 12, 14 are in their closed state. The extent to which the staple 30 extends beyond the slot 32 forward of the front surface of the bottom portion 22 is determined to allow a lock or more likely the shackle of a lockbox, to pass through the staple 30 and be secured around the staple 30 (FIG. 5).

To enable the staple 30 to pass through the slot 32, the bottom portion 22 of the first arm 12 is provided with a slotted part 34 connected to a base part 36 by a hinge 38 (FIG. 1). Slotted part 34 is slotted in the sense that it includes the slot 32. The slotted part 34 may be considered similar to a hasp, but is not required to be made from metal.

The staple 30 is passed through the slot 32 by, from when the first and second arms 12, 14 in the first, open state around the door lever 6 (FIG. 2), lifting the slotted part 34 upward to allow the first and second arms 12, 14 to be able to be positioned alongside one another (FIG. 3). Such a position is prevented in the open state when the slotted part 34 abuts against the staple 30 (FIG. 2). By lifting the slotted part 34 upward, the base part 36 can be moved alongside the bottom portion 28 of the second arm 14 and then the slotted part 34 can be lowered when the slot 32 aligns with the staple 30 (transition from FIG. 3 to FIG. 4). The bottom portions 22, 28 are thus alongside one another when the first and second arms 12, 14 are in the closed state.

When the first arm 12 is raised and the slotted part 34 is positioned and lowered over the staple 30, the first and second arms 12, 14 align one behind another and cannot spread out. In this position, the apparatus 10 is unable to open and slide off of or be removed from the door lever, or door knob. Locking the first and second arms 12, 14 in this position is also possible and preferred through use of a lock or lockbox whose shackle 2 is inserted through the exposed portion of the staple 30 (transition from FIG. 4 to FIG. 5).

The hinge 38 may be any type of hinge or other structure that provides for a rotational or pivotal connection of the slotted part 34 to the base part 36. As an example, the hinge 38 may be a non-removable hinge with two hinge parts (leaves), one of which is attached to the slotted part 34 and the other attached to the base part 36. The leaves may be permanently attachment, e.g., using screws that pass through apertures in each leaf, or may be incorporated or integrated into the design of the slotted part 34 and base part 36. The type and construction of the hinge 38 is not important the invention, only that the slotted part 34 is pivotable relative to the base part 36 via the hinge 38 (at least in this embodiment).

With respect to the material of the first and second arms 12, 14 of the apparatus 10, they may be made of a variety of materials, such as metal, and covered by a material that prevents damage to the door. For example, a protective covering or coating made of rubber or plastic would prevent scratching of the door and door handle when the apparatus 10 is installed.

Staple 30 may be secured to the bottom portion 28 in a variety of different ways, but regardless of which way, it is preferably secured thereto in a manner to prevent it from separating from the bottom portion 28, e.g., preferably permanently fixed to the bottom portion 28 of the second arm 14. It is possible to design the second arm 14 with an integral or incorporated staple 30.

Figure 6:
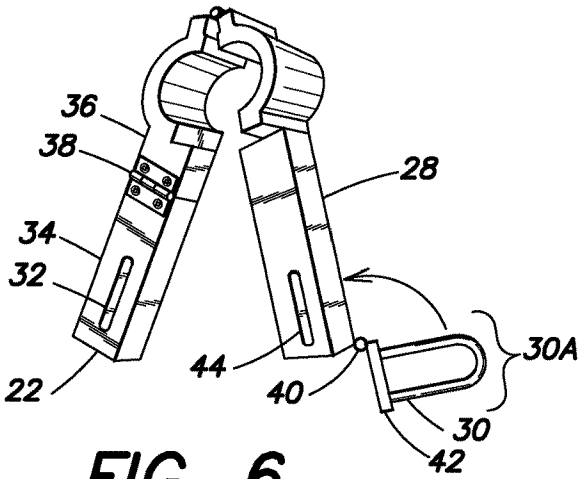

Instead of fixing the staple 30 to the bottom portion 28, it is possible to use a staple unit 30A that is movable relative to the second arm 14. For example, as shown in FIG. 6, instead of fixing the staple 30 to the bottom portion 28 as in FIG. 1, the staple unit 30A is pivotally attached to the bottom portion 28, e.g., at its lower edge region. As pivotal attachment means, a hinge 40 may be used to pivotally attach an optional backplate 42 connected to the staple 30 (thereby forming the staple unit 30A) to the bottom portion 28. Hinge 40 is configured and positioned relative to a slot 44 in the bottom portion 28 to enable the staple 30 to pivot into the slot 44 and also into the slot 32 in the slotted part 34 of the first arm 12 when the slot 32 aligns with the slot 44 such that the staple 30 extends sufficiently beyond the slot 32 to allow, for example, the shackle of a lockbox to pass through the staple 30 and be secured around the staple 30.

Figure 7:
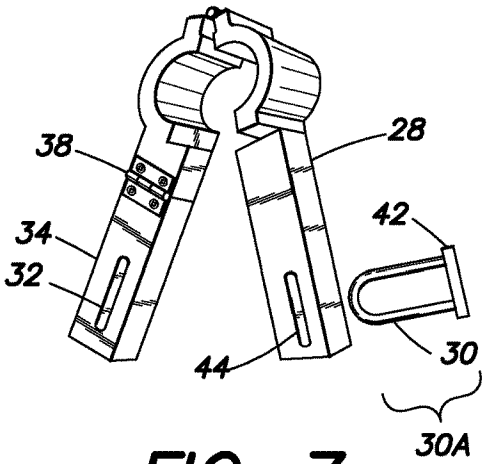

In FIG. 7, the staple unit 30A, including its optional backplate 42, is not attached at all to the bottom portion 28, but rather is a free, loose component. Staple unit 30A is dimensioned such that, when inserted through the slots 32, 44, the staple 30 thereof extends sufficiently beyond the slot 32 to allow the shackle of a lockbox to pass through the staple 30 and be secured around the staple 30.

Figure 8:
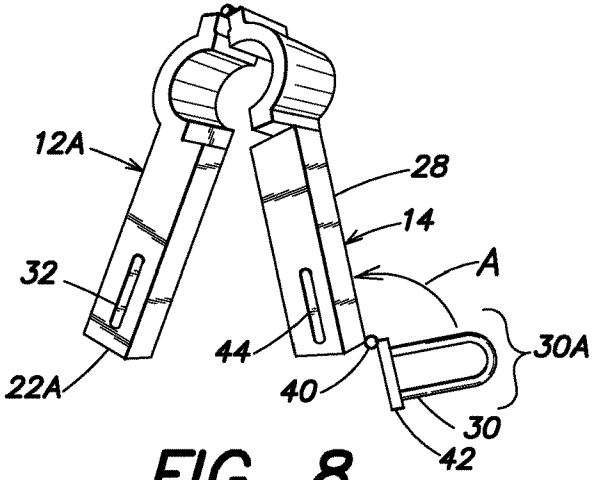
FIGS. 6-11 show different constructions of parts of the arms of the apparatus, namely, the bottom portions of the arms.

Although the embodiments in FIGS. 1-5 include a hinged first arm 12, it is also possible to construct the apparatus 10 without a hinged first arm, which first arm lacking a hinge is designated 12A in FIG. 8. First arm 12A is an elongate piece of material, e.g., metal with a protective coating or covering as mentioned above, and includes the slot 32, but not the hinge 38. Similar to FIG. 6, staple unit 30A is pivotally attached to the bottom portion 28, e.g., at its lower edge region, and as pivotal attachment means, hinge 40 is used to pivotally attach the optional backplate 42 to the bottom portion 28. The staple unit 30A is pivoted in the direction of arrow A into the slot 44 and aligning slot 32.

Figure 9:
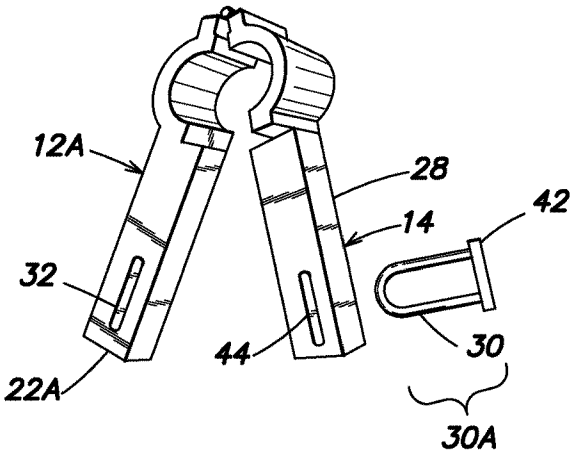

In FIG. 9, the staple unit 30A is not required to be attached to any part of the second arm 14, but rather can be a free, loose component (like in FIG. 7). A loose component is one which is not always connected to remaining parts of the apparatus 10. Staple unit 30A is dimensioned such that, when inserted through the slots 32, 44, the staple 30 thereof extends sufficiently beyond the slot 32 to allow the shackle of a lockbox to pass through the staple 30 and be secured around the staple 30. In this embodiment, both arms 12A, 14 lack a hinge component. As such, they may be rigid elongate members.

Figure 11:
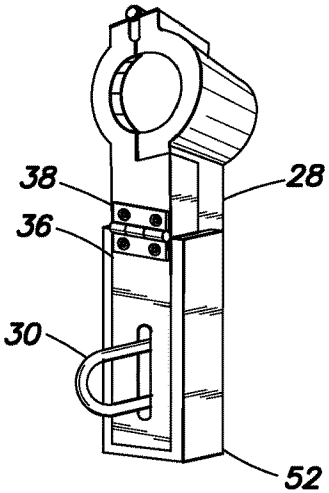
Figure 10:
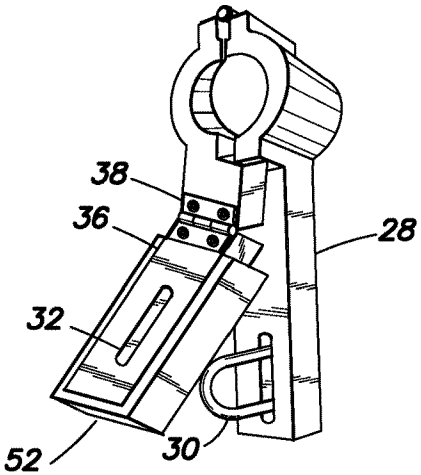

FIGS. 10 and 11 show use of skirts 52 situated on the lateral and bottom sides of the slotted part 34 that are configured to extend over the lateral and bottom sides of the bottom portion 28 when the first and second arms 12, 14 are in the closed state (see FIG. 11). These skirts 52 may be formed from the same material as the material of the slotted part 34, e.g., integral therewith, or from a separate and/or different material that is attached to the lateral and rear sides of the slotted part 34. Skirts 52 aid in positioning of the slotted part 34 over the bottom portion 28 because they define a three-sided receptacle into which the bottom portion 28 can be easily inserted as the slotted part 34 is pivoted over the staple 30.

Skirts 52 may be composed of a thin plate attached to the lateral and bottom sides of the slotted part 34 or a thin rim projecting rearward from the lateral and bottom edges of the rear-facing surface of the slotted part 34, or other comparable or functionally equivalent structure. One purpose of the skirts 52 is to form a U-shaped channel on the side of the slotted part 34 of the first arm 12 that faces the second arm 14 so that the second arm 14 is more easily retained in a pre-determined position against the first arm 12 when the first and second arms 12, 14 are in the closed state. Thus, skirts 52 generally represent means to aid in positioning of the slotted part 34 over the bottom portion 28.

Skirts 52 do not have to extend over the entire lateral and bottom sides of the slotted part 34 but may extend over only a portion thereof. The skirts 52 may also be fragmented into different parts and are not required to be situated on both of the lateral sides and bottom sides, but rather may be positioned on whichever sides are desired.

The first and second arms 12, 14 may be connected together to keep them together with in the first, open state. For example, the first and second arms 12, 14 may be connected together at an upper edge region to enable the arms 12, 14 to pivot about this upper edge region between the first and second states while in continual connection to one another. To this end, connecting means are provided on the apparatus 10 to connect the first and second arms 12, 14 together to enable them to be manually moved between the first and second states. The connecting means encompass structure that connects the first and second arms 12, 14, together to enable them to have two positions, one in which it is possible to place the apparatus 10 over the part of the door handle to be received in the aperture 16 formed by the connection of the first and second arms 12, 14 (which position is referred to as the open position), and another position in which the apparatus 10 is configured to enable the first and second arms 12, 14 to be engaged with and preferably locked to one another (which position is referred to as the closed position). These connecting means may be any known connecting mechanism that functions to selectively connect two parts together. The parts do not have to be connected when in the open position, e.g., via a hinge, but could be completely separate when in the open position (see FIG. 14).

As an exemplifying, non-limiting embodiment of the connecting means, a hinge 46 may be provided at an upper edge regions of the first and second arms 12, 14. When pivoted into the open state about hinge 46, it is possible to bring the apparatus 10 over the part of the door lever 6 to be received in the aperture 16 through the space between the first and second arms 12, 14 (FIG. 2). The first and second arms 12, 14 are then pivoted into the closed state about hinge 46 to cause the part of the door lever 6 to be received in aperture 16 which is formed upon moving the first and second arms 12, 14 to their closed state. In the closed state, the first arm 12 is situated on the left side of the door lever 6 with the recess 20 alongside the part of the door lever 6 received in aperture 16 and the second arm 14 is situated on the right side of the door lever 6 with the recess 26 alongside the part of the door lever 6 received in aperture 16.

Figure 12:
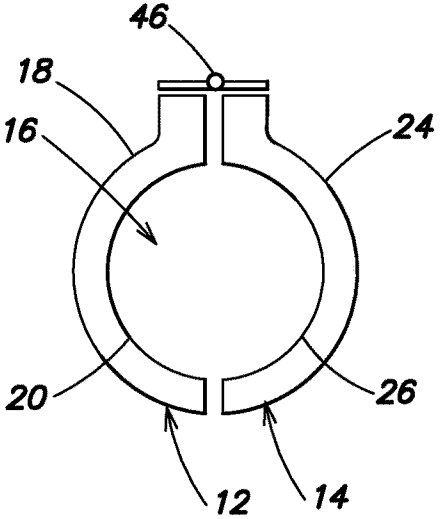

Hinge 46 may be a non-removable hinge with two planar hinge parts, called leaves, each attached to an upper surface of a respective one of the first and second arms 12, 14. The leaves each have knuckles through which a pin passes and enables pivotal movement of the leaves relative to one another, and thus pivotal movement of the first and second arms 12, 14 relative to one another. Attachment of the leaves to the first and second arms 12, 14 may be a permanent attachment, e.g., using screws that pass through apertures in each leaf into and through the upper surfaces of the head portion 18, 24, or may be incorporated or integrated into the design of the head portions 18, 24 of the respective first and second arms 12, 14. A cross-sectional view of the head portions 18, 24 including the hinge 46 is shown in FIG. 12.

Figure 13:
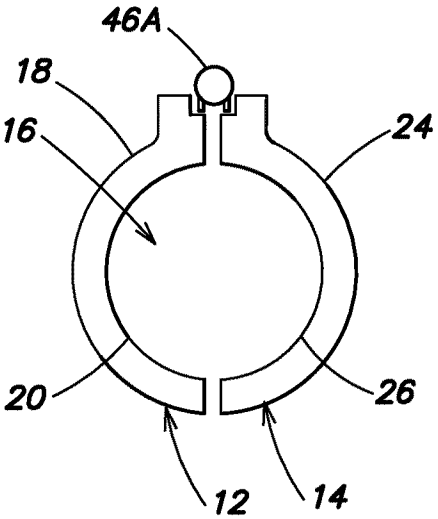

FIG. 13 shows an alternative hinge 46A wherein the leaves are embedded into the head portions 18, 24 and not alongside the upper surface.

Figure 14:
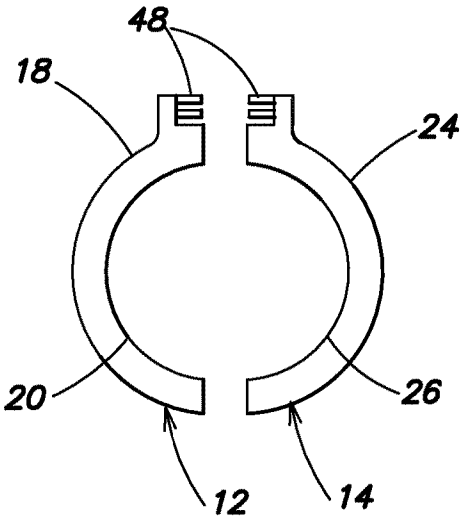
FIGS. 12-15 show different constructions of the head portions of the arms of the apparatus.

FIG. 14 shows connecting means that do not comprise a hinge, namely, wherein the connecting means comprise pins 48 on each head portion 18, 24 and which pins 48 cooperate with one another to provide a closed and secure state of the first and second arms 12, 14 (only the head portions 18, 24 of which are shown, with the bottom portions 22, 28 being any of the bottom portions disclosed herein). The pins 48 are removably attached to one another and can be forcibly separated from one another when installing and removing the apparatus 10. By suitable design of the dimensions of the apparatus 10, the pins 48 cannot be separated from one another to enable removal of the apparatus from the door lever 6 to which the apparatus 10 is attached when a lock or lockbox shackle is present in the staple 30.

Figure 15:
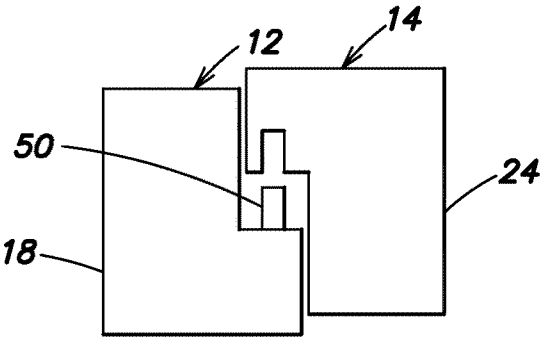

FIG. 15 is a top view of another connecting means wherein the first and second arms 12, 14 are provided with an integrated hinge 50 formed by structure of the head portions 18, 24 themselves. The integrated hinge 50 can be replaced by any other structure that forms an integrated pivot structure, which structures are known to or readily ascertainable by those skilled in the art, and are considered to be encompassed by the invention.

To enable the apparatus 10 be used with variable-sized door levers 6 or other types of door handles, various mechanisms are provided to adjust the size of the aperture 16, referred to herein as adjusting means for adjusting a size of the aperture 16 to improve the retention of the apparatus 10 on the door lever 6. These mechanisms are generally configured to reduce the size of the aperture 16 from a largest possible size determined by the construction of the apparatus 10.

Figure 16:
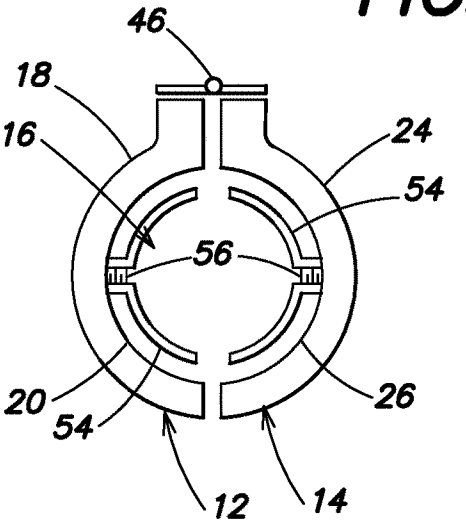
FIGS. 16-18 show different constructions of the head portions of the arms to enable adjustment of the size of the hole defined by the head portions.

FIG. 16 shows the presence of a generally semi-circular plate 54 inward of each inner surface of the head portions 18, 24. The semi-circular plates 54 occupy a small portion of each recess 20, 26 defined by the head portions 18, 24, i.e., are situated on opposite sides of the aperture 16. The semi-circular plates 54 are configured and dimensioned to avoid interfering with one another when the apparatus 10 is in the closed state.

Adjustment of the position of the semi-circular plates 54 relative to the inner surfaces of the respective head portion 18, 24 is effected by tightening or loosening set screws 56 which results in the aperture 16 being larger or smaller depending on the direction of rotation of the set screws 56. Other known mechanisms to effect movement of a plate, to result in a change in the size of the aperture 16 in the invention, are also considered part of the invention.

In another embodiment, a functionally comparable or equivalent mechanism is integrated into the apparatus 10 which when rotated, moves the semi-circular plates 54 in and out, which the end result also being a variation in the size of the aperture 16. Adjustment of the size of the aperture 16 may be effected before the apparatus 10 placed over the door lever 6 or while the apparatus 10 is around the door lever 6.

Figure 17:
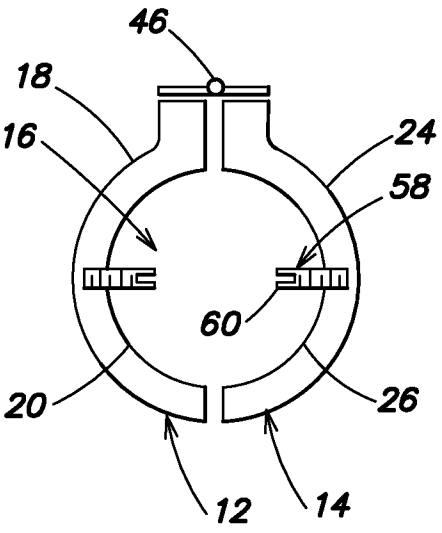
Figure 20:
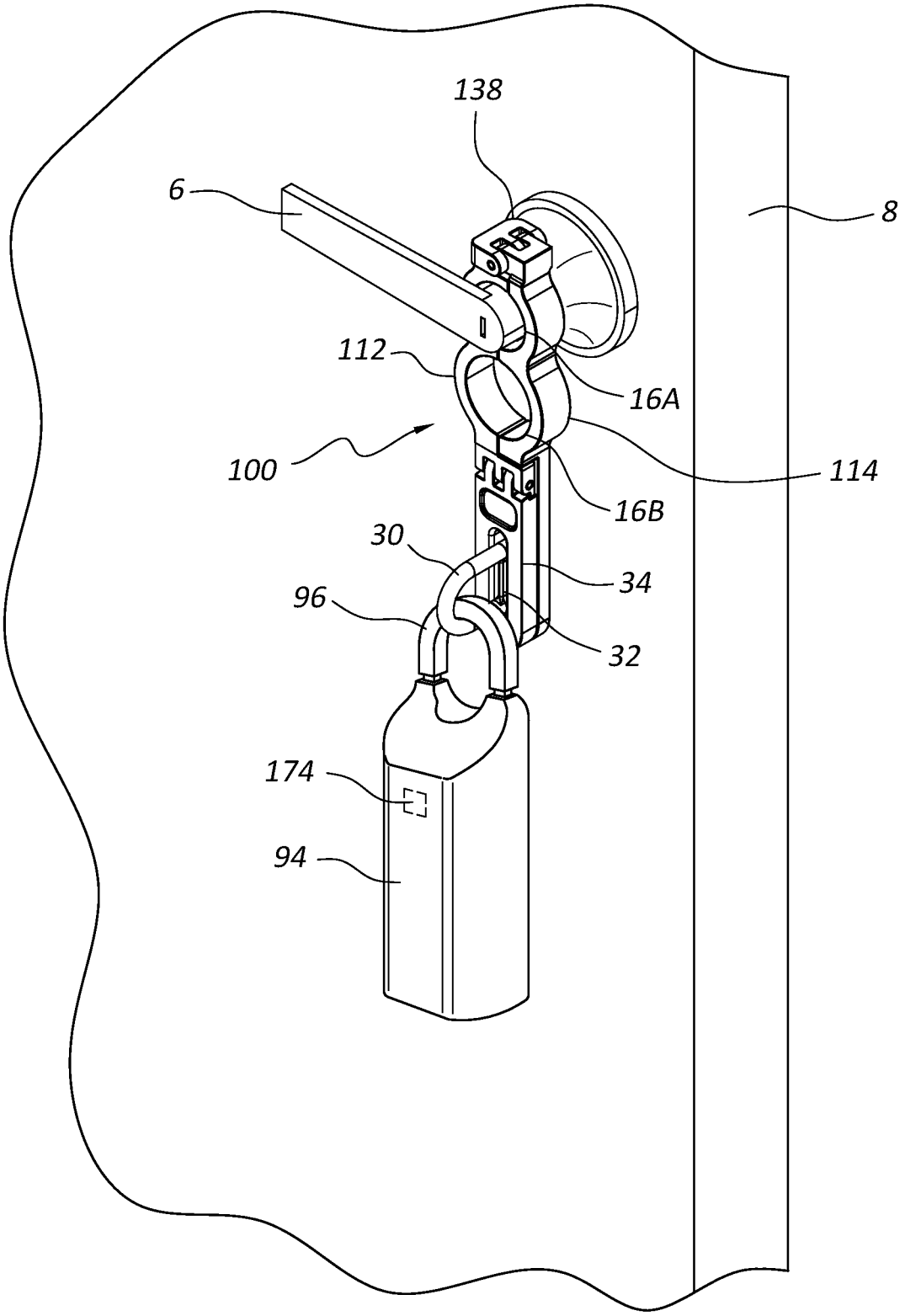
FIG. 20 is a perspective view of another embodiment of an apparatus in accordance with the invention shown in an exemplifying use.
Figure 21:
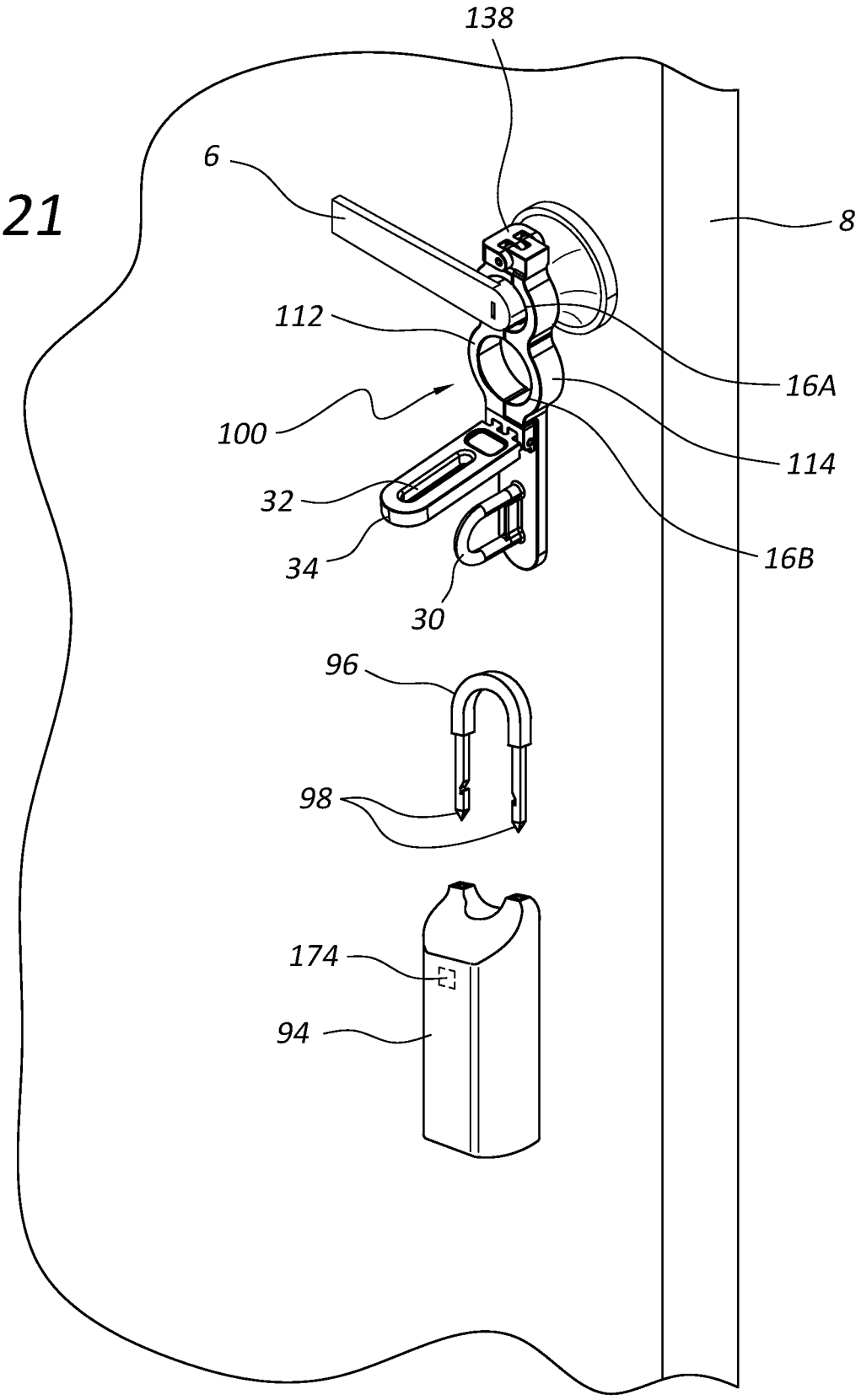
FIG. 21 is an exploded perspective view of the embodiment shown in FIG. 20 shown in preparation for use.

FIG. 17 shows another adjusting mechanism or means for adjusting the size of the aperture 16. In this embodiment, a respective rotatable set screw 58 is installed in each head portion 18, 24 and has an edge 60 projecting into the recess 20, 26 a distance that varies as a function of the rotation of the set screw 58. The set screws 58 are thus on opposite sides of the aperture 16, but not necessarily opposite one another. The user, when seeking to reduce the size of the aperture 16 from a larger, possibly initial setting, can place a screwdriver or other tool or instrument in a slot of the set screw 58 and rotate it until the edge 60 is positioned close to or against the door lever 6. The apparatus 10 would then be secured to the door lever 6.

In another embodiment, a functionally comparable or equivalent mechanism is integrated into the apparatus 10 or set screws 58 which when rotated, moves the set screws 58 in and out, which the end result also being a variation in the size of the aperture 16. Adjustment of the size of the aperture 16 via rotation of the set screws 58 may be effected before the apparatus 10 placed over the door lever 6 or while the apparatus 10 is around the door lever 6.

In this embodiment, adjustment of the set screws 58 can reduce the overall size of aperture 16, i.e., the size of the head hole, and provide a more secure attachment of the apparatus 10 to the door lever 6.

Figure 18:
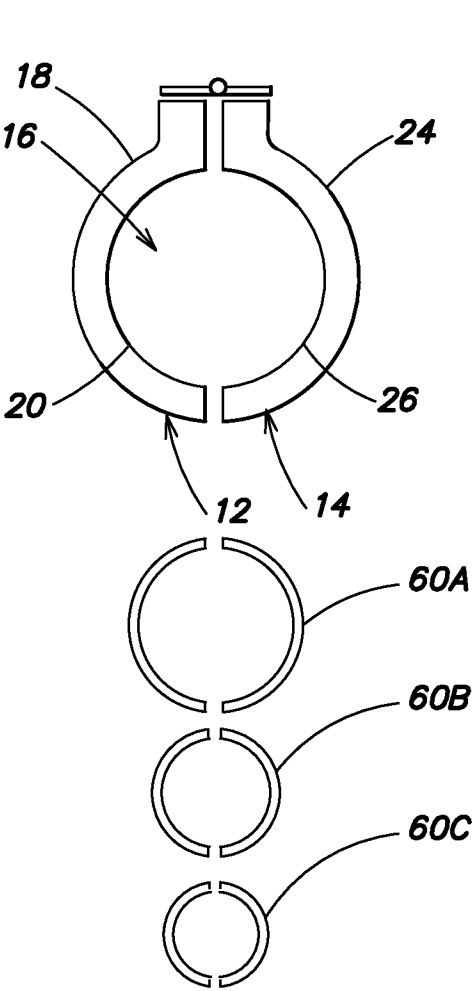

FIG. 18 shows yet another adjusting mechanism or means to adjust the size of the aperture 16 in order to provide a more secure attachment of the apparatus 10 to, for example, the door lever 6. Specifically, it is possible to provide variable-sized head hole inserts 60A, 60B, 60C that are inserted into the aperture 16, one into each recess 20, 26, and change the diameter of the aperture 16 when present therein. Inserts 60A, 60B, 60C may have a semi-circular cross-section, i.e., are semi-cylindrical, and the inserts of each pair are substantially identical. The specific one of the pairs of inserts 60A, 60B, 60C to use for each door handle is user-selectable and positionable around the door lever 6 depending on the diameter of the portion of the door lever 6 around which the apparatus 10 is to be positioned.

The inserts 60A, 60B, 60C can be easily inserted into the recesses 20, 26, and removed therefrom when desired. In contrast to the use of semi-circular plates and an adjustment mechanism as in the embodiment in FIG. 16, in this embodiment the inserts 60A, 60B, 60C may be loosely inserted into the recesses 20, 26 and secured in place around the door lever 6 when the first and second arms 12, 14 are moved into the closed state.

Figure 19:
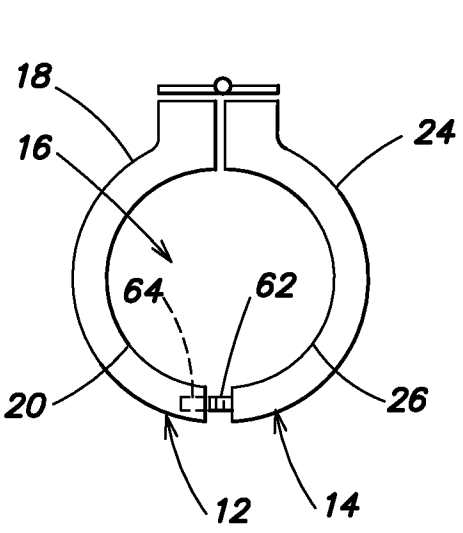
FIG. 19 shows a construction of the head portions that improves attachment of the head portions together in the closed state of the arms of the apparatus.

FIG. 19 illustrates a mechanism to improve the attachment of the head portions 18, 24 together. The surfaces of the head portions 18, 24 facing one another are provided with complementary mating structures, for example, a pin 62 and a pin hole 64. By inserting the pin 62 in the pin hole 64 upon closure of the first and second arms 12, 14, the head portions 18, 24 becomes less susceptible to being forced or pried open. The pin 62 and pin hole 64 represent means for releasably securing the head portions 18, 24 together when the apparatus 10 is in the closed state. Other known structures that provide this functionality are considered to be part of the invention, and one skilled in the art would understand how to incorporate them into the invention based on the disclosure herein.

The inventor contemplates combining any of the head portions 18, 24 of the first and second arms 12, 14 shown in FIGS. 12-19 with any of the bottom portions 22, 28 shown in FIGS. 6-11. As such, a large number of variations of the apparatus 10 are possible and considered within the scope of the invention. Moreover, the complementary mating structure shown in FIG. 19 may be used with and integrated into any of the other head portions disclosed herein.

It is possible to construct the apparatus 10 in various sizes, for example with various size apertures 16, various depths of the head portions 18, 24 (depth being the front to back distance), and various thickness of the head portions 18, 24 (thickness being the distance between the inner facing surface of the head portions 18, 24 that define the respective recess 20, 26 and the outer facing surfaces).

Apparatus 10 can thus be constructed to fit most door hardware styles including but not limited to door handles that are in the form of a lever, ball, biscuit, and tulip door knob styles.

There are numerous advantages of the invention. For example, in some embodiments, there are no loose components (aside from the embodiments of FIGS. 7 and 9). The staple 30 is attached to the second arm 14 and the first and second arms 12, 14 are attached to one another. A single, unitary assembly is thus formed which prevents loss of any particular piece and aids in maintaining the functionality of the apparatus 10.

Moreover, a characteristic of the invention believed to be unique when used to secure a lockbox to a door handle, and in the lockbox assembly of the invention, is that the lockbox can be secured to the door handle without having any part of the lockbox surround or encompass the door handle. That is, the shackle of a conventional lockbox typically is around the door handle when the lockbox is secured to a door handle. However, using apparatus 10, since there is a head portion 18, 24 on each arm 12, 14 which cooperate to surround the door handle (or least a part thereof), and then the bottom portions 22, 28 of the arms 12, 14 are situated below the respective head portion 18, 24, the shackle of the lockbox is engaged with the bottom portions 22, 28 below the head portions 18, 24 and therefore below the door handle. For example, the shackle of the lockbox can be attached to the staple 30 that projects through the slot 32 in the first arm 12, i.e., the shackle is inserted through an opening defined by the staple 30 in front of the front surface of the bottom portion 22 of the first arm 12. The lockbox is therefore entirely below the door handle (as clearly seen in FIG. 5). This is very advantageous since the lockbox, when secured to the apparatus 10 in turn secured to the door handle, should not interfere with the movement of the door handle to open or close the door.

Modifications of the apparatus 10 described above are contemplated. In one modification, the apparatus 10 is integrated into a shackle of, for example, a lockbox. In this case, instead of needing two components, i.e., a lockbox and the apparatus 10, a single component or lockbox assembly is provided and can be manufactured and sold as an integrated unit.

Another modification of the apparatus 10 involves the use of inserts that can be placed into the aperture 16 to change the shape and/or diameter of the aperture 16 and accommodate different shapes and diameters of door handles.

FIGS. 20-27 show another embodiment of an apparatus 100 in accordance with the invention for which the same features, characteristics, and properties of apparatus 10 and its components can be incorporated to the extent possible and not inconsistent with the different features of apparatus 100 as described below. Apparatus 100 is shown with an exemplifying, non-limiting lock box assembly including a key box 94 having a compartment capable of containing one or more gate cards, keys or other access mechanism and which is manually or electronically opened via an access control mechanism represented schematically as 174 (as known to those skilled in the art to which this invention pertains), and a U-shaped shackle 96 that is completely removable from the key box 94 and includes two shackle prongs 98 each with a notch. Key box 94 with its cooperating U-shaped shackle 96 is an example of a lock box that may be used in this embodiment with apparatus 100 and are not intended to limit the invention in any manner whatsoever. Indeed, other locks, lock boxes and key boxes with a cooperating locking structure may be used in the invention. Apparatus 100 though is an independent component usable independent of the lock, lock box or key box, but preferably used with one of these components. Other uses of the apparatus 100 than those described herein are therefore possible.

In apparatus 100, there is a first elongate arm 112 and a second elongate arm 114 which are similar to first and second arms 12, 14, respectively, except that the first and second arms 112, 114 are configured to define two different-sized apertures 16A, 16B between them when in the closed state (see FIGS. 22 and 23), instead of a single aperture 16 as in apparatus 10 (see FIGS. 10 and 11). Aperture 16A defines a smaller cylindrical space than aperture 16B, and is situated vertically above aperture 16B when the first and second arms 112, 114 are in the closed state (although the opposite placement is possible). Apertures 16A, 16B are thus alongside or adjacent one another and separated from one another in the longitudinal direction of the apparatus 100 by parts of the first and second arms 112, 114, i.e., separated in the longitudinal direction of the first and second arms 112, 114. Within the scope of the invention is an apparatus with more than two different-sized apertures alongside or adjacent one another, e.g., a line of three different-sized apparatus in the longitudinal direction, and thus it may be considered that the apparatus 100 includes at least two or a plurality of different-sized apertures.

With multiple different-sized apertures, apparatus 100 can be installed around different-sized door levers, door handles, etc., with the specific sized aperture 16A, 16B being selected for use dependent on the size of the door lever 6, door handle, etc. A user can try to position the apparatus 100 by moving the first and second arms 112, 114 from the open state to the closed state such that aperture 16A is placed around the door lever 6 and if it is too small and the door lever 6 does not fit in aperture 16A, the user can position the apparatus by moving the first and second arms 112, 114 from the open state to the closed state such that aperture 16B is placed around the door lever 6. It is preferable to use the smallest size aperture possible to avoid the apparatus 100 being only loosely fit around the door lever 6 and thus possibly removable when the first and second arms 112, 114 are in the closed state The same manner in which aperture 16 can be formed by the first and second arms 12, 14 in different ways as discussed above is also applicable to the formation of apertures 16A and 16B. For example, the first arm 112 includes a head portion 118 at an upper region of the member that defines two recesses 120, 122 and an elongate bottom portion 124 below the head portion 118. The second arm 114 includes a head portion 126 at an upper region of the member that defines two recesses 128, 130 and an elongate bottom portion 132 below the head portion 126. The head portions 118, 126 constitute an upper portion of the apparatus 100 while the bottom portions 124, 132 constitute a lower portion of the apparatus 100. Bottom portion 132 supports the U-shaped staple 30.

Each recess 120, 128 has the same generally semi-circular cross-section in the depth direction of the respective member but its shape can vary and is not limited to being semi-circular or even uniform in the depth direction of the first and second arms 112, 114. Recesses 120, 128 have a shape relative to one another to form the aperture 16A with a cylindrical form, but this cylindrical form is not a required feature and may vary for different embodiments.

Each recess 122, 130 has the same generally semi-circular cross-section in the depth direction of the respective member but its shape can vary and is not limited to being semi-circular or even uniform in the depth direction of the first and second arms 112, 114. Recesses 122, 130 have a shape relative to one another to form the aperture 16B with a cylindrical form larger than the cylindrical form of aperture 16A, but this cylindrical form is not a required feature and may vary for different embodiments. Head portions 118, 126 are therefore provided with curved forms are shown.

The bottom portion 124 of the first arm 112 has an upper end region integral with the head portion 118, but may alternatively be connected thereto if formed from separate members. This upper end region is formed primarily by a hinge part 168 described below. The bottom portion 124 also includes slotted part 34 with the slot 32 as described above. The bottom portion 132 of the second arm 114 has an upper end region integral with the head portion 126, but may alternatively be connected thereto if formed from separate members. The staple 30 extends forward of a front surface of the bottom portion 132.

For this embodiment, structure to adjust the size of the aperture is not required, although not precluded, since the apparatus 100 provides two different-sized apertures 16A, 16B and the sizes of these apertures 16A, 16B can be selected in view of the size of common door levers, door handles etc., to enable apparatus 100 to be capable of use with most if not all such door levers, door handles and the like. Use of mechanisms disclosed above, see, e.g., FIGS. 16-18, to adjust the size of one or both of apertures 16A, 16B would further improve the fit provided by apparatus 100.

Figure 22:
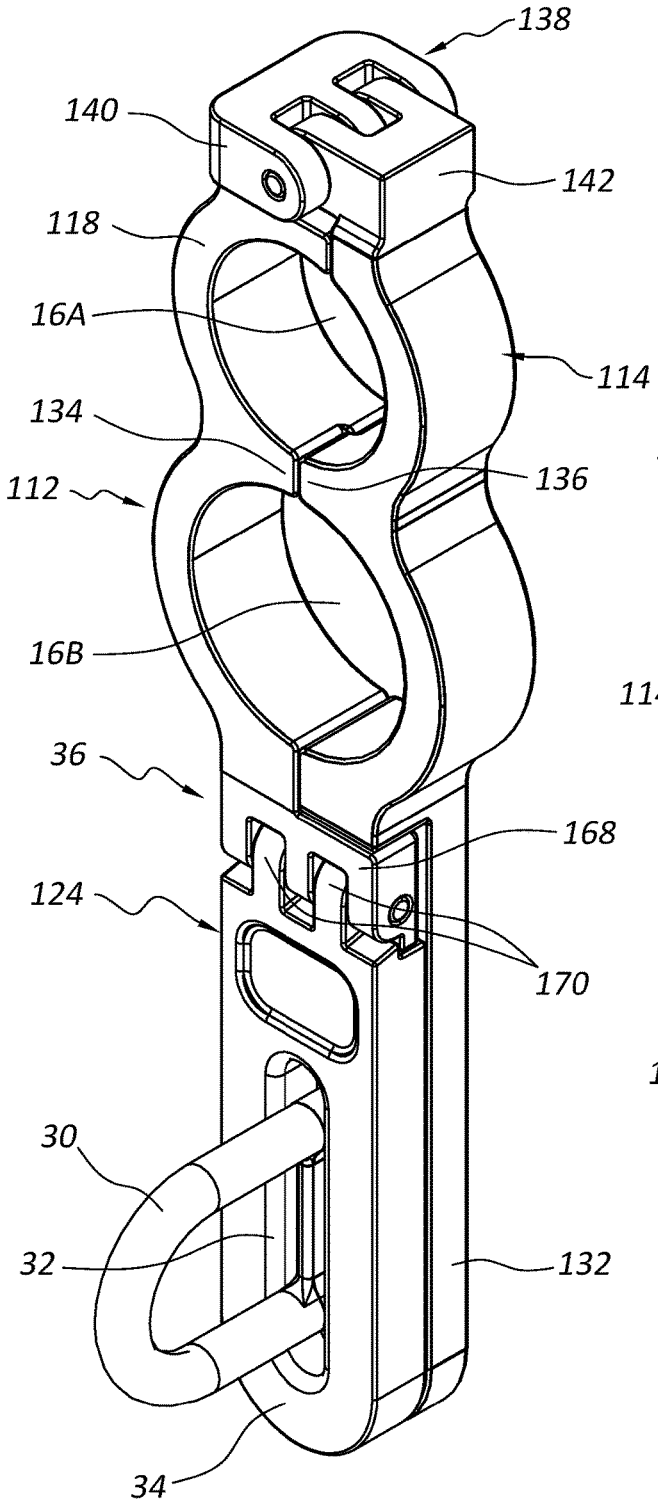
FIG. 22 is a front perspective view of the apparatus shown in FIG. 20.
Figure 23:
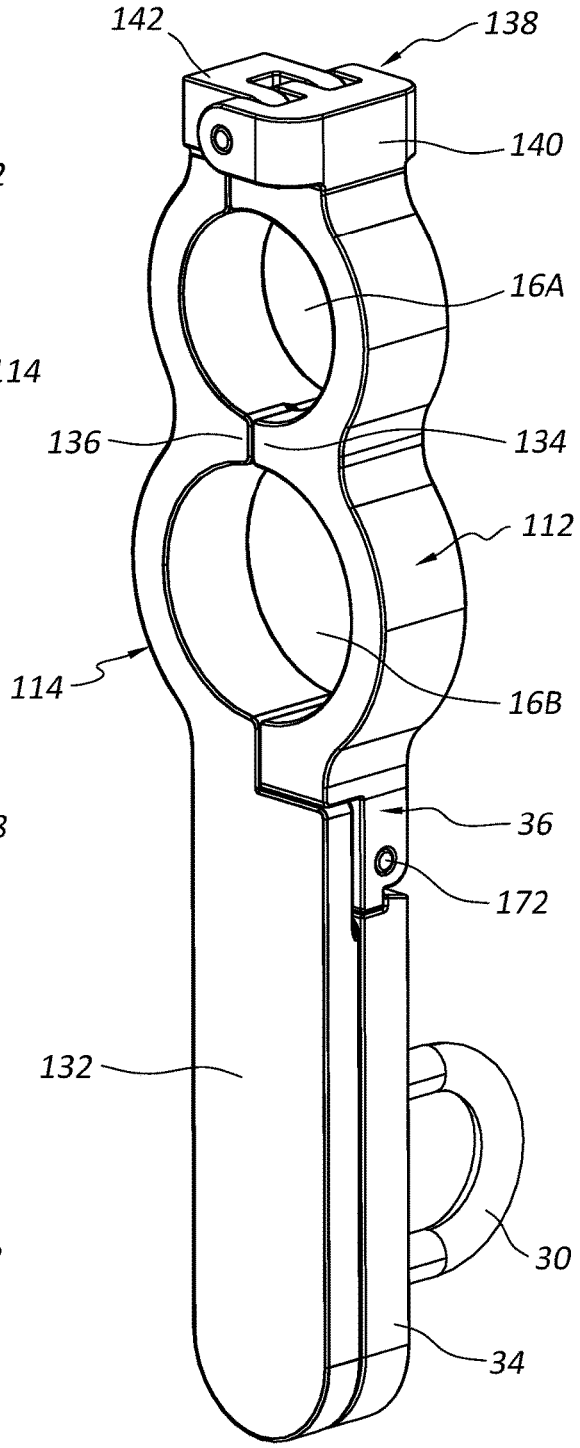
FIG. 23 is a rear perspective view of the apparatus shown in FIG. 20.
Figure 24:
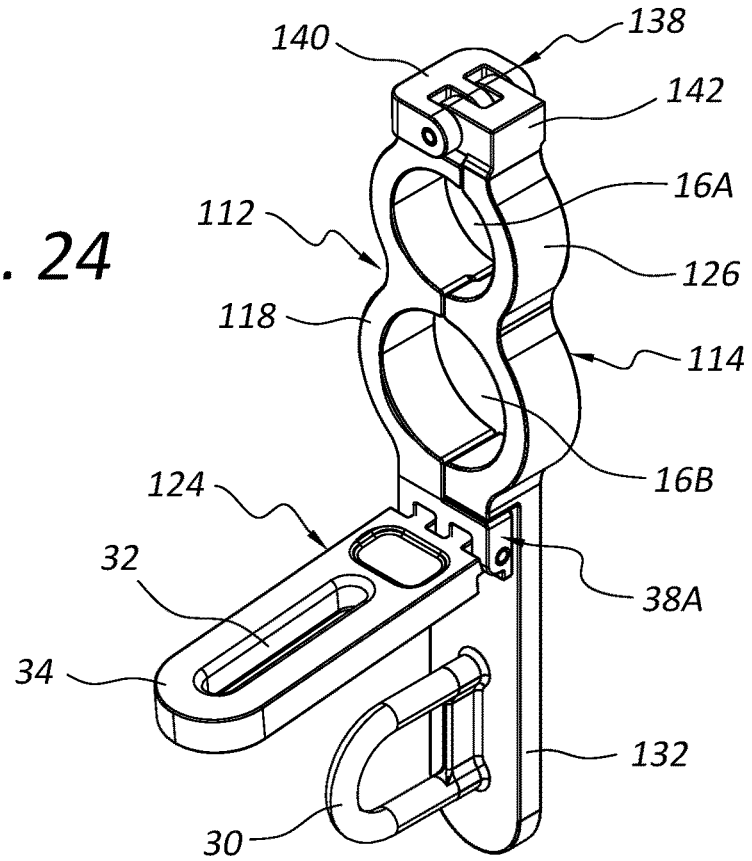
FIG. 24 is a perspective view of the apparatus shown in FIG. 20 in a closed state.
Figure 25:
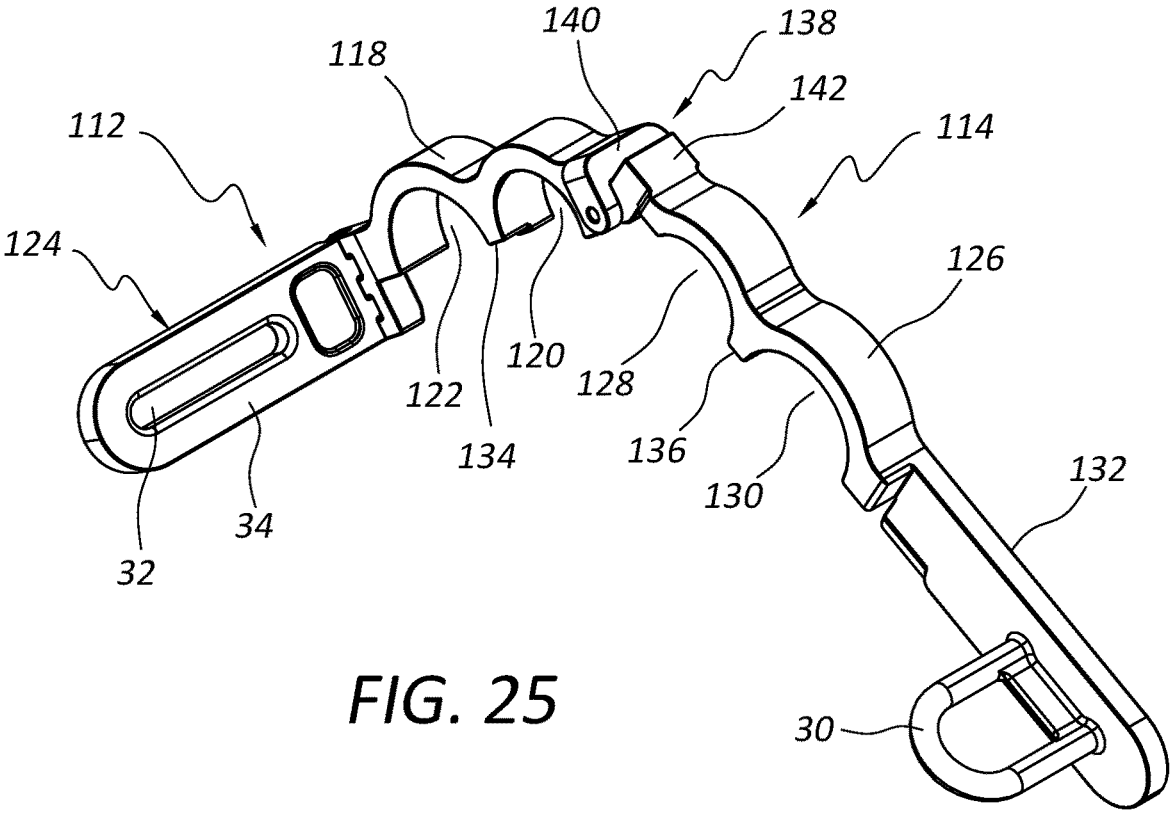
FIG. 25 is a perspective view of the apparatus shown in FIG. 20 in an open state.
Figure 26:
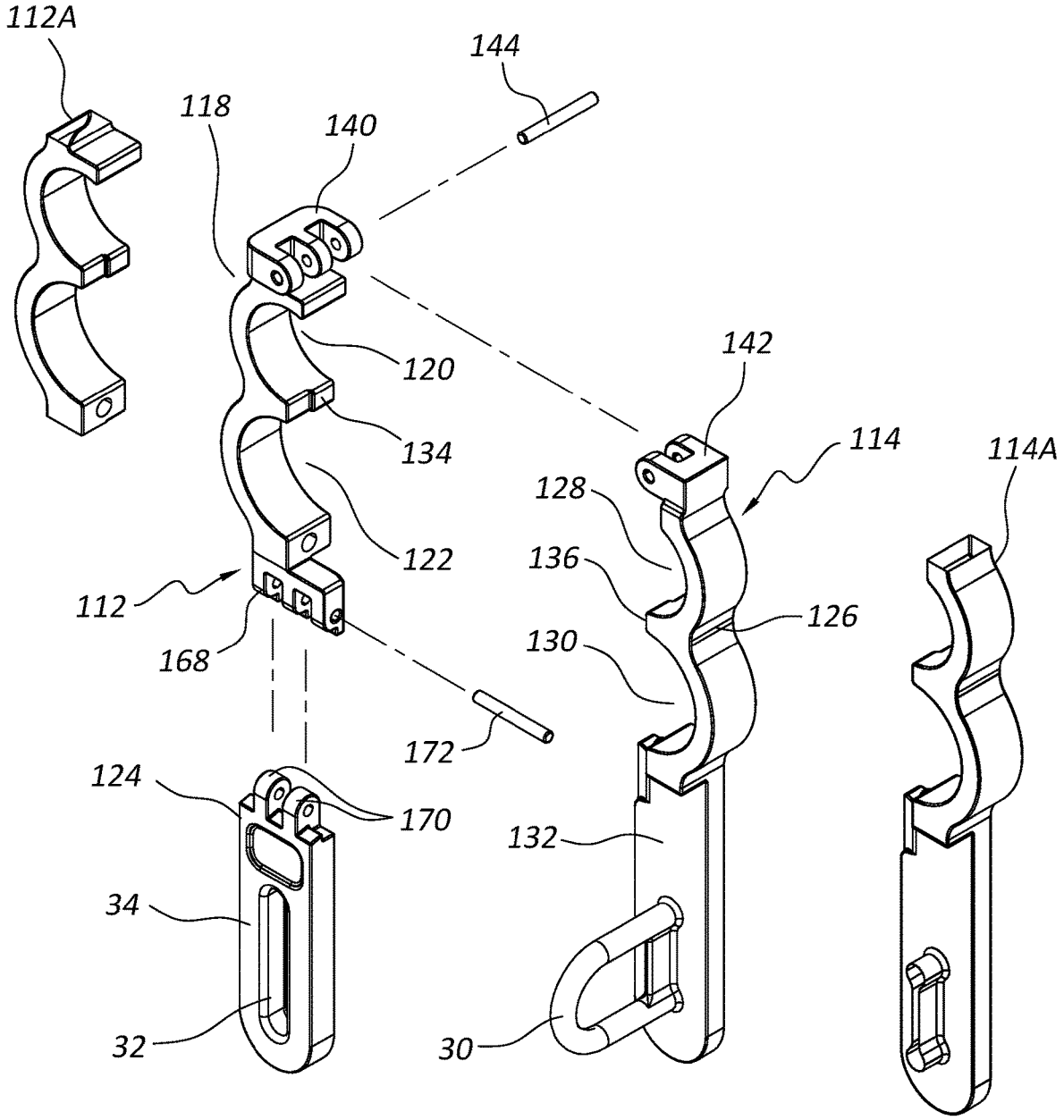
FIG. 26 is an exploded front perspective view of the apparatus shown in FIG. 20.
Figure 27:
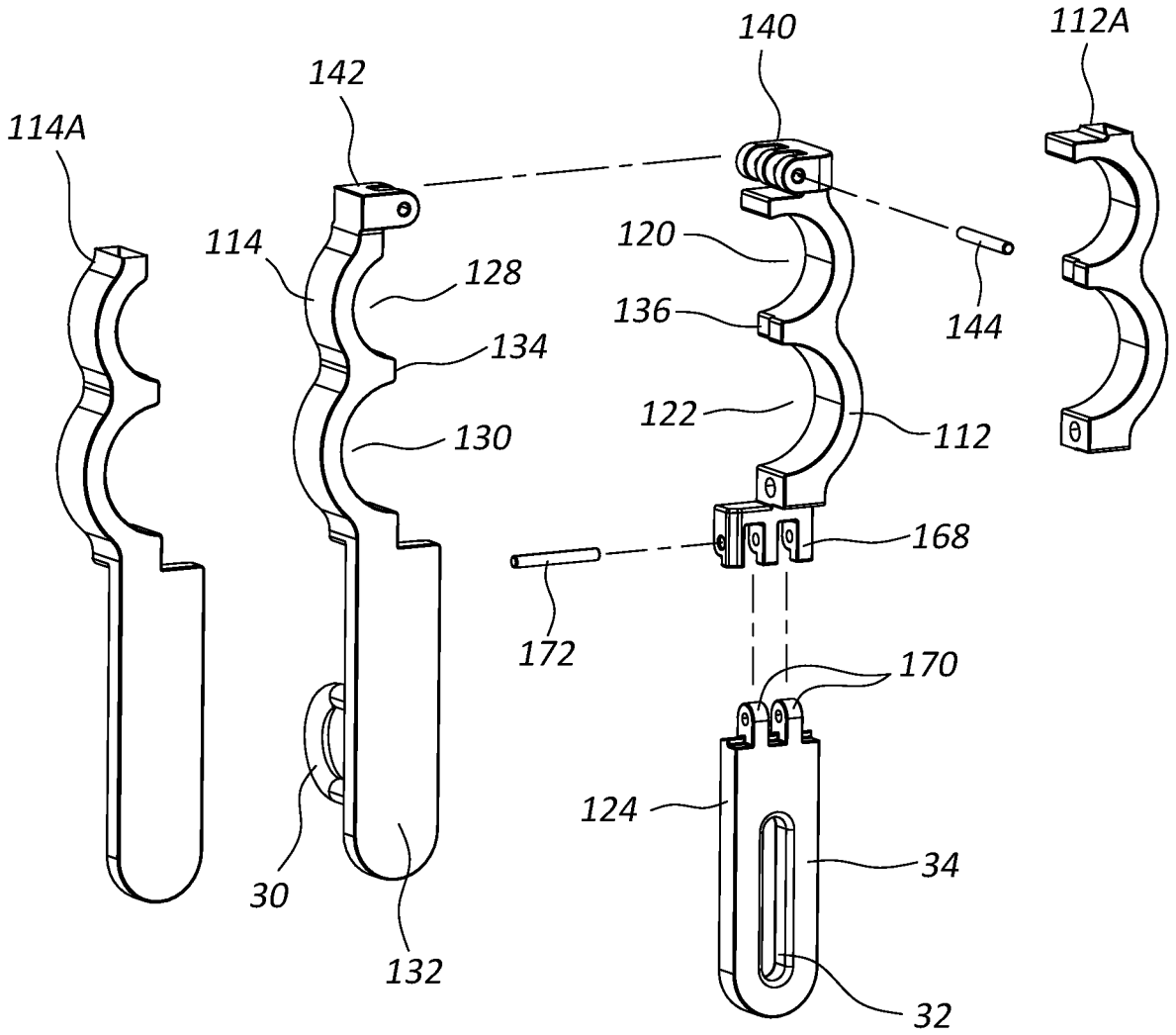
FIG. 27 is an exploded rear view of the apparatus shown in FIG. 20.

The first arm 112 has an intermediate region 134 between the recesses 120, 122 while the second arm 114 has an intermediate region 136 between the recesses 128, 130 which contacts intermediate region 134 when the first and second arms 112, 114 are in the closed state (see FIGS. 22 and 23). This contact aids in retention of a door lever 6 in one of the apertures 16A, 16B. Preferably, there is surface contact between the intermediate regions 134, 136 although this is not required so long as the apertures 16A, 16B can be defined without enabling removal of the door lever, door handle and the like when the first and second arms 112, 114 are in their closed state.

The structure that maintains the first and second arms 112, 114 in the second, closed state and prevents their movement from the second, closed state to the first, open state has various forms, and may be the same as for apparatus 10, e.g., the engagement means including the staple 30 on the second arm 114 and cooperating slotted part 34 on the first arm 112.

Another difference between apparatus 100 and other embodiments of the apparatus 10 relates to hinge 138 in apparatus 100 above the apertures 16A, 16B. Hinge 138 has an E-shaped first hinge part 140 on, e.g., formed integral with, the first arm 112 and a C-shaped second hinge part 142 on, e.g., formed integral with, the second arm 114 intermeshed with hinge part 140. A hinge pin 144 extends parallel to the axes of the apertures 16A, 16B, and has its ends secured on hinge part 140 and passes through apertures in hinge part 142 and the central leg of hinge part 140 (see FIGS. 26 and 27). Other hinges disclosed herein for connecting first and second arms 112, 114 could be used on apparatus 100 and hinge 138 could be used as the hinge on the other apparatus 10 disclosed herein.

Yet another difference is the construction of a hinge 38A to connect the slotted part 34 to the base part 36. In this embodiment, the base part 36 of the bottom portion 124 comprises an E-shaped part 168 adjacent the head portion 118, while the slotted part 34 comprises two extensions 170 formed thereon, e.g., integral therewith or as part thereof. A hinge pin 172 passes through the E-shaped part 168 and extensions 170 to enable pivotal movement of the slotted part 34 relative to the base part 36 and thus to the head portion 118 (see FIGS. 26 and 27). Hinge 38A can be used as a substitute for hinge 38 and vice versa.

Optional rubber covers 112A and 114A may be provided for the first and second arms 112, 114. These rubber covers 112A, 114A are a surface covering for the typically metal material of the first and second arms 112, 114 and do not affect the formation of the apertures 16A, 16B or recesses or any other structure of the first and second arms 112, 114 that is to be covered by the rubber covers 112A, 114A, respectively, As such, the rubber covers 112A, 114A may be considered part of the first and second arms, 112, 114 respectively.

As described above, the apparatus 10, 100 generally are used to secure a lock or lockbox to a door handle and especially a door lever used as a door handle. However, this described use of the apparatus 10, 100 is not intended to limit the invention and other uses are possible and should be considered within the scope and spirit of the invention.

Figure 28:
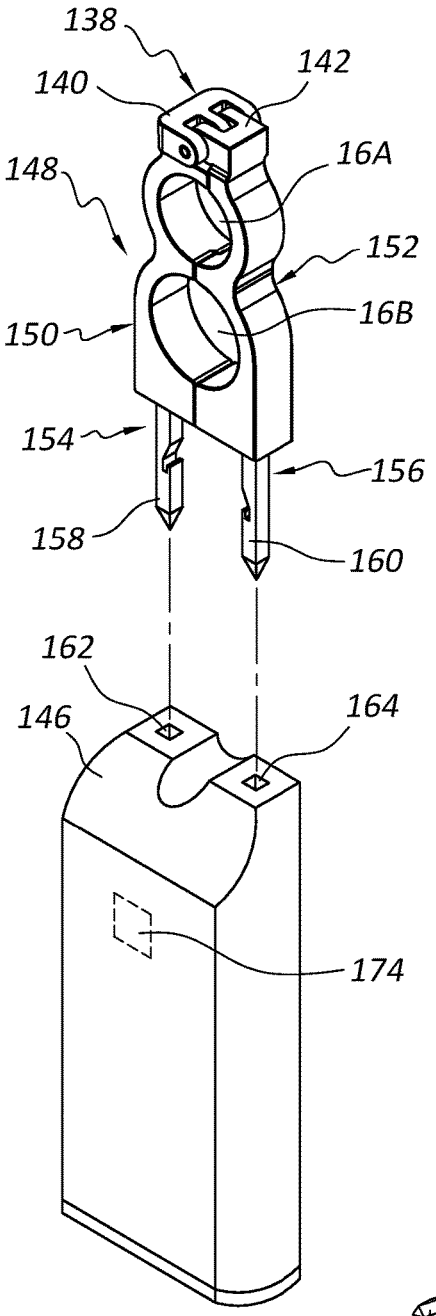
FIG. 28 is a view of another embodiment of an apparatus in accordance with the invention in an unlocked state.
Figure 29:
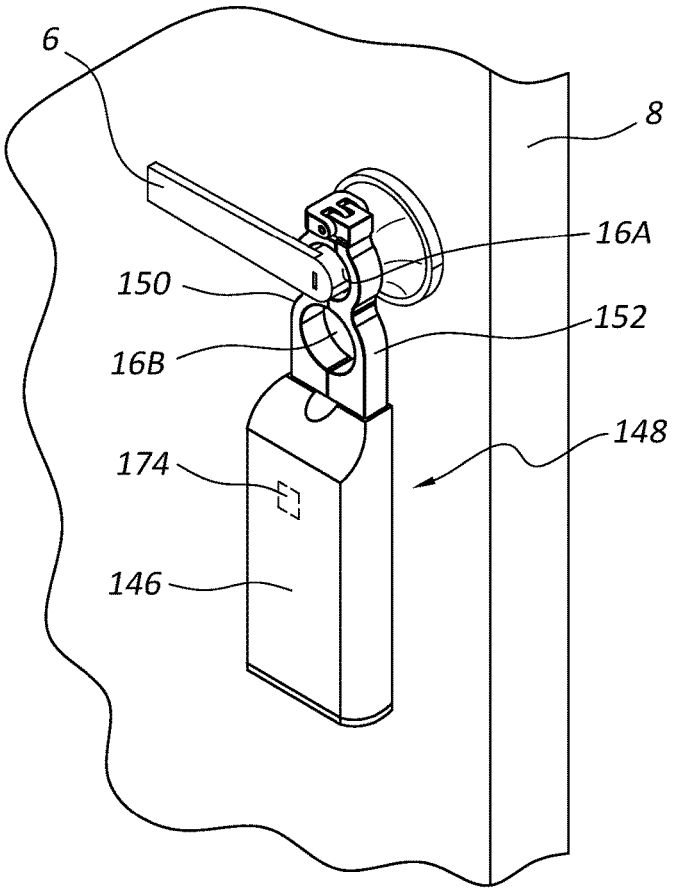
FIG. 29 is a view of the apparatus shown in FIG. 28 in a locked state.
Figure 30:
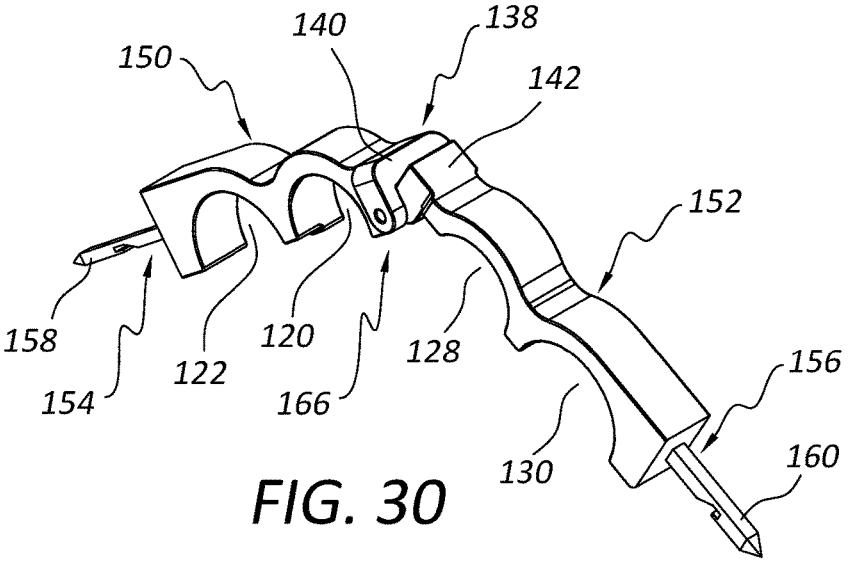
FIG. 30 is a view of part of the apparatus shown in FIG. 28 in an open state.

FIGS. 28-30 show an alternative configuration of a lock box assembly wherein a key box 146 of an existing lockbox assembly, e.g., the iBox BT LE sold under the trademark SUPRA® is used as part of an apparatus 148 in accordance with the invention. Key box 146 includes a compartment capable of containing one or more gate cards, keys or other access mechanism and which is electronically opened. The SUPRA® key box 146 is also configured to receive a U-shaped shackle that is completely removable from the key box 146 and includes two shackle prongs. Other key boxes like this one may be used in the invention.

To engage with key box 146, apparatus 148 includes a first arm 150 and a second arm 152 which are similar to first and second arms 112, 114, respectively, except that bottom portions 154, 156 of the first and second arms 150, 152 each include an elongate shackle prong 158, 160 extending downward in a direction away from the head portions 118, 126. The shackle prongs 158, 160 are spaced apart the same distance as complementary receptacles 162, 164 in the key box 146 to enable them to easily insert into the receptacles 162, 164 and lock into the key box 146. Shackle prongs 158, 160 are generally parallel to one another and may have the same axial length. A notch is provided in each shackle prong 158, 160 in a manner known to those skilled in the art to which this invention pertains.

The shackle prongs 158, 160 are releasable from the key box 146 when a shackle code is received by electronic circuitry in the key box 146 (or alternatively depending on the construction of the key box 146, a shackle code is manually entered into a code-receiving component in the key box 146). The manner in which the shackle code is entered, received and processed by the key box 146 is not critical to the invention and all that is required is that upon entry of a correct shackle code, both shackle prongs 158, 160 are removable from engagement with the key box 146. The shackle prongs 158, 160 are engaged with the key box 146 by lining up the shackle prongs 158, 160 with the receptacles 162, 164 in the key box 146 and pushing the shackle prongs 158, 160 down into the key box 146 until they click.

A different code is used to access the key compartment in the key box 146, and manner in which the key access code is entered, received and processed by the key box 146 is not critical to the invention. The mechanism to receive the shackle code and key code either manually or electronically is represented schematically as 174.

Elongate shackle prongs may be included on the first and second arms 12, 14 of apparatus 10 instead of the engagement means disclosed above. As such, the bottom portions 22, 28 of the first and second arms 12, 14 may each be provided with an elongate shackle prong extending downward in a direction away from the head portions 18, 24 and used with the key box 146. Such shackle prongs would be similar to shackle prongs 158, 160 and an apparatus in accordance with the invention would therefore include first and second arms having head portions like the head portions 18, 24 of any of the first and second arms 12, 14 disclosed herein, shackle prongs on or as the bottom portions, and a key box. Among other things, a separate lock engaged with a staple is not required for such an apparatus.

Shackle prongs 158, 160 are part of an engagement structure that enables engagement of the key box 146 to the arm sub-assembly 166. This engagement structure may be any structure that enables two prongs, one from each of the arms, to engage with and be lockable to structure in or on the key box 146. As shown, this structure is the formation of elongate members as prongs with notches that engage with complementary structure inside the key box 146. Other structure is also possible including structure of the elongate members that engages outside of the key box, structure of the elongate members that engage with each other and then with structure in or on the key box 146, and structure of the elongate members that engage with a common structure in or on the key box. All such structure is encompassed with the term engagement structure or engagement means, the basic functionality of this structure or means being to provide a connection between both of the arms and a common key box while preventing separation of the arms while the engagement structure is engaged with and locked into the key box.

Accordingly, an embodiment of the invention is possible wherein the first and second arms each include an engagement structure that cooperates with mating engagement structure on a lock, lock box or key box so that when the first and second arms are in a closed state, it is possible to engage the lock, lock box or key box with the engagement structure and lock the first and second arms in a closed position around a door knob, door lever, door handle and the like. Only unlocking of the lock, lock box or key box enables disengagement of the engagement structure on the first and second arms from the lock, lock box or key box and then opening of the first and second arms to enable release of the first and second arms from the door knob, door lever, door handle and the like (for repositioning of the apparatus). When installed on a door knob, door lever, door handle or the like with a lock box or key box, a realtor can manually or electronically enter a code to access a key or other access device in a compartment in the lock box or key box and enter a premises for a showing.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. Apparatus, comprising:

a first arm having a head portion and a bottom portion below said head portion, said bottom portion of said first arm including a first shackle prong extending in a direction away from said head portion;

a second arm having a head portion and a bottom portion below said head portion of said second arm, said bottom portion of said second arm including a second shackle prong extending in a direction away from said head portion of said second arm, said first and second arms having a first, open state in which said head portions of said first and second arms are at least partly separated from one another, and a second, closed state in which at least one aperture is defined between said head portions of said first and second arms; and a key box having a compartment for containing an access device, and first and second receptacles that receive said first and second shackle prongs when said first and second arms are in said second, closed state, said key box having a first state in which said first and second shackle prongs are out of said first and second receptacles and a second state in which said first and second shackle prongs are locked in said first and second receptacles, said key box transitioning from the second state to the first state upon entry of a shackle release code, said key box enabling access to said compartment upon receiving an access code different than the shackle release code, whereby said first and second arms are positionable around a door handle or removable from such a position when in the first, open state and one of said at least one aperture is receivable of the door handle when said first and second arms are in the second, closed state, whereby when said key box is in the second state, said first and second arms are maintained in the second, closed state and movement of said first and second arms from the second, closed state to the first, open state is prevented and thus, when said first and second arms are around the door handle with the door handle received in one of said at least one aperture, said first and second arms are maintained around the door handle.

2. The apparatus of claim 1, wherein said at least one aperture defined between said first and second arms in the second, closed state comprises two separated, different-sized apertures.

3. The apparatus of claim 2, wherein said head portions of said first and second arms each include a pair of recess and said pairs of recesses combine to form said two apertures.

4. The apparatus of claim 2, wherein said two apertures are spaced apart from one another in a longitudinal direction of said first and second arms.

5. The apparatus of claim 2, wherein one of said two apertures closer to said bottom portions of said first and second arms has a larger cross-sectional area than one of said two apertures farther from said bottom portions of said first and second arms.

6. The apparatus of claim 1, further comprising connecting means for connecting said first and second arms together above said at least one aperture.

7. The apparatus of claim 6, wherein said connecting means comprise a hinge at an upper edge region of said head portions of said first and second arms such that said first and second arms are connected together in both the first, open and second, closed states.

8. Apparatus, comprising:

an upper portion defining at least one aperture configured to fit around a door handle;

a lower portion below said upper portion and comprising two shackle prongs extending in a direction away from said upper portion; and a key box having a compartment for containing an access device, and two receptacles that receive said shackle prongs when said upper and lower portions are in a closed state, said key box having a first state in which said shackle prongs are out of said receptacles and a second state in which said shackle prongs are locked in said receptacles, said key box transitioning from the second state to the first state upon entry of a shackle release code, said key box enabling access to said compartment upon receiving an access code different than the shackle release code, wherein movement of said upper and lower portions from the closed state to an open state in which said at least one aperture is open is prevented when said key box is in the second state.

9. The apparatus of claim 8, wherein said at least one aperture defined by said upper portion comprises two separated, different-sized apertures.

10. The apparatus of claim 9, wherein said two apertures are spaced apart from one another in a longitudinal direction of said upper portion.

11. The apparatus of claim 9, wherein one of said two apertures closer to said lower portion has a larger cross-sectional area than one of said two apertures farther from said lower portion.

12. The apparatus of claim 8, wherein said upper portion comprises a head portion of a first arm and a head portion of a second arm, and said lower portion comprises a bottom portion of said first arm below said head portion of said first arm and a bottom portion of said second arm below said head portion of said second arm, said first and second arms having a first, open state in which said head portions of said first and second arms are at least partly separated from one another, and a second, closed state in which said at least one aperture is defined between said head portions of said first and second arms whereby said first and second arms are positionable around the door handle or removable from such a position when in the first, open state and one of said at least one aperture is receivable of the door handle when said first and second arms are in the second, closed state.

13. The apparatus of claim 8, wherein said upper and lower portions are integral with one another.

14. Apparatus, comprising:

a first arm having a head portion and a bottom portion below said head portion, said bottom portion of said first arm including a first prong extending in a direction away from said head portion;

a second arm having a head portion and a bottom portion below said head portion of said second arm, said bottom portion of said second arm including a second prong extending in a direction away from said head portion of said second arm, said first and second arms having a first, open state in which said head portions of said first and second arms are at least partly separated from one another, and a second, closed state in which at least one aperture is defined between said head portions of said first and second arms; and a key box having a compartment for containing an access device, and engagement structure for engaging with said first and second prongs when said first and second arms are in said second, closed state, said key box having a first state in which said first and second prongs are disengaged with said engagement structure and a second state in which said first and second prongs are engaged with and locked in said engagement structure, said key box transitioning from the second state to the first state upon entry of a release code, said key box enabling access to said compartment upon receiving an access code different than the release code, whereby said first and second arms are positionable around a door handle or removable from such a position when in the first, open state and one of said at least one aperture is receivable of the door handle when said first and second arms are in the second, closed state, whereby when said key box is in the second state, said first and second arms are maintained in the second, closed state and movement of said first and second arms from the second, closed state to the first, open state is prevented and thus, when said first and second arms are around the door handle with the door handle received in one of said at least one aperture, said first and second arms are maintained around the door handle.

15. The apparatus of claim 14, wherein said first and second prongs are shackle prongs spaced apart from one another and said engagement structure comprises two receptacles each receivable of a respective one of said shackle prongs.

16. The apparatus of claim 14, wherein said at least one aperture defined between said first and second arms in the second, closed state comprises two separated, different-sized apertures.

17. The apparatus of claim 16, wherein said head portions of said first and second arms each include a pair of recess and said pairs of recesses combine to form said two apertures.

18. The apparatus of claim 16, wherein said two apertures are spaced apart from one another in a longitudinal direction of said first and second arms, and one of said two apertures closer to said bottom portions of said first and second arms has a larger cross-sectional area than one of said two apertures farther from said bottom portions of said first and second arms.

19. The apparatus of claim 14, further comprising connecting means for connecting said first and second arms together above said at least one aperture.

20. The apparatus of claim 19, wherein said connecting means comprise a hinge at an upper edge region of said head portions of said first and second arms such that said first and second arms are connected together in both the first, open and second, closed states.

* * * * *